United States Patent [19]

Pearce

[11] 3,931,697

[45] Jan. 13, 1976

[54] MODULAR CURVED SURFACE SPACE STRUCTURES

[75] Inventor: Peter J. Pearce, Studio City, Calif.

[73] Assignee: Synestructics, Inc., Chatsworth, Calif.

[22] Filed: May 13, 1974

[21] Appl. No.: 469,416

Related U.S. Application Data

[63] Continuation of Ser. No. 216,488, Jan. 10, 1972, abandoned.

[52] U.S. Cl. ..... 52/80; 52/79; 52/DIG. 10

[51] Int. Cl.[2] ..... E04B 1/32

[58] Field of Search ..... 52/80, 81, 79, 83, DIG. 10

[56] References Cited

UNITED STATES PATENTS

| | | | |
|---|---|---|---|
| 2,928,360 | 3/1960 | Heine | 52/80 |
| 3,663,347 | 5/1972 | Schoen | 52/80 |

FOREIGN PATENTS OR APPLICATIONS

| | | | |
|---|---|---|---|
| 966,344 | 7/1957 | Germany | 52/80 |
| 967,000 | 9/1957 | Germany | 52/80 |

OTHER PUBLICATIONS

Surfaces Minimales ... pp. 89–96, L'Architecture D'Anjourd Hui; May 1969.

Mathematical Models by Cundy & Rollett, pp. 100–105, 158, 159 and 178–181, 1961.

*Primary Examiner*—Ernest R. Purser
*Assistant Examiner*—H. E. Raduazo
*Attorney, Agent, or Firm*—Marvin H. Kleinberg

[57] ABSTRACT

A plurality of mathematically interrelated modular structures are disclosed which are based on a series of minimal surfaces bounded by skewed polygons. Some six basic modules are described which are capable of being interconnected in various combinations to form finite volume enclosing structures. Appropriately scaled, the modules could be used as structure toys, to create playground equipment or, for the construction of habitible structures. Utilizing these structural modules, it is possible to construct large assemblies having parallel planar structures within the enclosed space which could be considered floors and ceilings of multi-level structures.

8 Claims, 67 Drawing Figures

A MODULE

B MODULE

C MODULE

C' MODULE

D MODULE

E MODULE

F MODULE

FIG. 11.
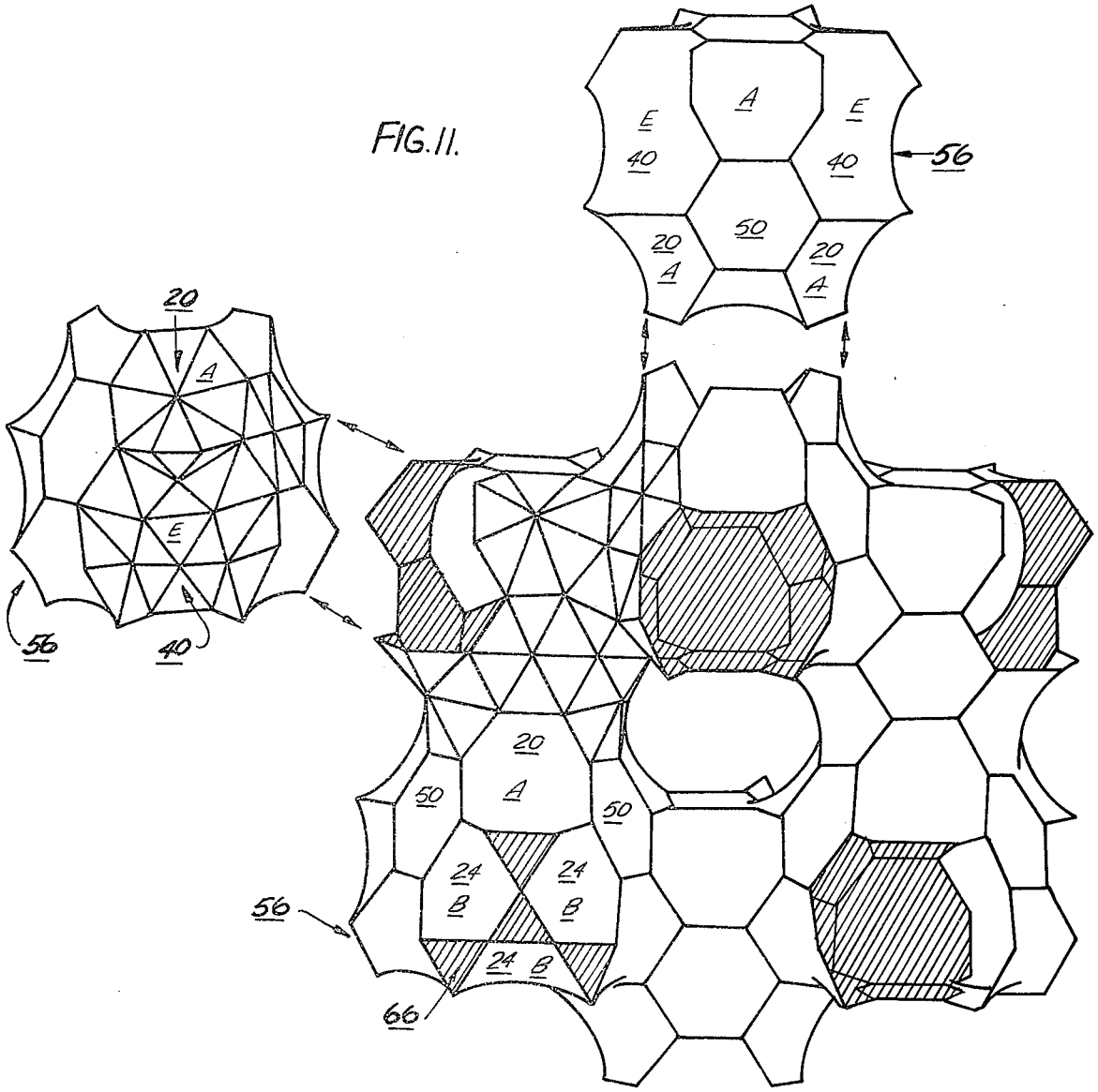
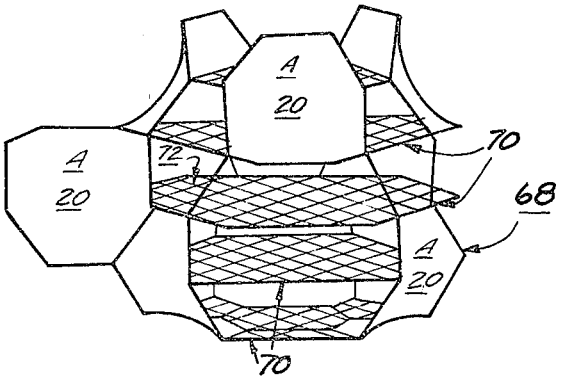
FIG. 12

FIG. 19a.
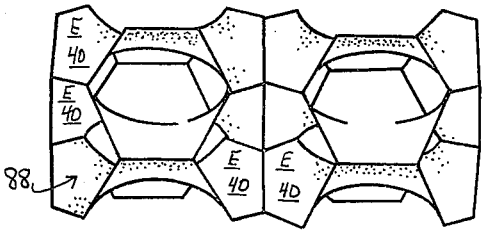
FIG. 19b.
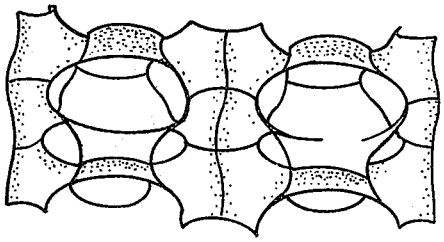
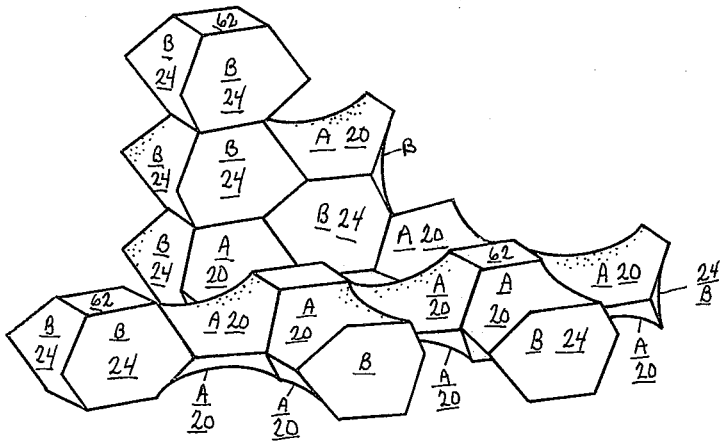
FIG. 20

SECTION A-A

SECTION A-A

SECTION B-B

MODULAR CURVED SURFACE SPACE STRUCTURES

This is a continuation of application Ser. No. 216,488, filed Jan. 10, 1972, and now abandoned.

The present invention relates to modular structural elements and, more particularly, a series of saddle type curved surface polygonal modules which can combine and repeat in various add mixtures to form a collection of spatial structures capable of efficiently enclosing and subdividing space.

BACKGROUND OF THE INVENTION

From time to time, in the prior art, suggestions have been made that closed finite polyhedra made up of saddle shaped polygons spanned by minimal surfaces are possible and M. Burt has, in a book entitled "Spatial Arrangements and Polyhedra With Curved Surfaces and Their Architectural Applications", published by Technion, Haifa, Israel, in November of 1966, described a set of polyhedra. Three of Burt's polyhedra can be used to form unary space filling systems. Some of the others are capable of combinations which provide spans, trusses and other architectural elements.

Others, have in recent years, proposed minimal curved surfaces for use as core structures, such as is taught in the patent to Robb, U.S. Pat. No. 3,227,598; or in walls, as is shown in Hauer, U.S. Pat. No. 3,038,278. Similarly, the patent to Hale, U.S. Pat. No. 3,525,663 teaches a cellular core structure using curved surfaces.

According to the present invention, a plurality of curved surface modules are derived as approximations of surfaces of least area, relative to closed polyogonal perimeters. Each module starts with a non-planar skew polygon. When a minimal surface is bounded by the skew polygon, the result is a saddle like, smooth surface which tends to optimize distribution of stress.

Utilizing the concepts of the present invention, a fundamental set of six primary interrelated curved surface modules has been derived. The set includes an octagonal figure, two hexagonal figures, one of which can be modified into pentagonal shape, and three dodecagonal figures. The included angles between adjacent edges of the polygons tend to be either 90°, 120°, or 135°. The dihedral angles between intersection planes of the skew polygons are either 125° 16′ or 109° 28′. Within these constraints, the edge lengths can be established for a given set of modules.

Sets of modules can be assembled and interconnected to form structures which can enclose space as simple finite polyhedra, or as continuous structures capable of virtually indefinite extension. The structures thus created would include curved space labyrinths having complementary tunnel regions which are identical or congruent. Certain of these spatial configurations are adapted to employ, in addition to the curved surface structural modules, planar, regular polygons.

In yet other embodiments, adapted for use in playground equipment, simple connectors have been devised to couple modules together into appropriate structures. Such techniques include plastic hinged joints as well as hingeable flanged couplers, channel members and the like.

In the preferred embodiment of the present invention, the individual modules will be made from rigid or semi-rigid materials so as to resist both tension and compression loads. A plurality of polygonal units can be arranged so that a single continuous membrane can be substituted for a series of interconnected individual modules in a minimal surface which conforms to the several polygons.

A triangulated skeletal approximation can be derived from each curved surface module. Such an approximation would utilize the teachings of a copending application of the inventor entitled "Minimum Inventory Maximum Diversity Building System," filed Aug. 30, 1971, U.S. Ser. No. 176,220. Such structures would utilize strut members to form the perimeter of the module, and other strut members would be used to triangulate the structure to afford structural rigidity.

In another embodiment, an alternative triangulated approximation can be created from a plurality of planar, triangular elements replacing the skeletal strut members. As is taught in the copending Pearce application, supra, a plane triangular plate would be the full structural equivalent of a skeletal frame of the same shape or outline.

It is, therefore, an object of the present invention to provide a set of minimal surface, polygonal modules that are capable of being assembled into integral, self-supporting structures.

It is an additional object of the invention to provide a family of realted, polygonal modules that can be assembled into novel and challenging play structures.

It is a further object of invention to provide a family of related, polygonal modular shapes that can be utilized as a construction toy.

The novel features which are believed to be characteristic of the invention, both as to organization and method of operation, together with further objects and advantages thereof will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

FIG. 1 is a perspective view of a multi-story structure composed of modules according to the present invention;

FIG. 2, including FIGS. 2*a* through 2*e*, inclusive, relates to an octagonal curved surface module according to the present invention in which FIG. 2*a* is a perspective view of the intersecting planes which help define the module; FIG. 2*b* is a perspective view of a minimum surface module so defined; FIG. 2*c* is a perspective view of a triangulated planar approximation of the module; FIG. 2*d* is a top view of the module triangulated by skeletal struts; and FIG. 2*e* is a modification of the module wherein arcs replace certain of the linear edges.

FIG. 3, including FIGS. 3*a* through 3*e*, inclusive, relates to a hexagonal curved surface module according to the present invention in which FIG. 3*a* is a perspective view of the intersecting planes which help define the module; FIG. 3*b* is a perspective view of a minimum surface module so defined; FIG. 3*c* is a perspective view of a triangulated planar approximation of the module; FIG. 3*d* is a top view of the module triangulated by skeletal struts; and FIG. 3*e* is a modification of the module wherein arcs replace certain of the linear edges.

FIG. 4, including FIGS. 4*a* through 4*h*, inclusive, relates to an alternative hexagonal curved surface module according to the present invention in which FIG. 4*a* is a perspective view of the intersecting planes which help define the module; FIG. 4*b* is a perspective view of a minimum surface module so defined; FIG. 4*c* is a perspective view of a triangulated planar approximation of the module; FIG. 4*d* is a top view of the module triangulated by skeletal struts; FIG. 4*e* is a modification of the module wherein arcs replace certain of the linear edges; FIG. 4*f* is a perspective view of the module of FIG. 4*b* modified to a pentagonal shape; FIG. 4*g* is a perspective view of a triangulated planar approximation of the modified module; and FIG. 4*h* is a top view of the modified module triangulated by skeletal struts.

FIG. 5, including FIGS. 5*a* through 5*f*, inclusive, relates to a dodecagonal curved surface module according to the present invention in which FIG. 5*a* is a perspective view of the intersecting planes which help define the module; FIG. 5*b* is a perspective view of a minimal surface module so defined; FIG. 5*c* is a perspective view of a triangulated planar approximation of the module; FIG. 5*d* is a top view of the module triangulated by skeletal struts; FIG. 5*e* is a modification of the module wherein arcs replace certain of the linear edges; and FIG. 5*f* is a further modification in which all straight edges are replaced by curves.

FIG. 6, including FIGS. 6*a* through 6*e*, inclusive, relates to an alternative, symmetrical dodecagonal surved surface module according to the present invention in which FIG. 6*a* is a perspective view of the intersecting planes which help define the module; FIG. 6*b* is a perspective view of the module so defined; FIG. 6*c* is a perspective view of a triangulated planar approximation of the module, FIG. 6*d* is a top view of the module triangulated by skeletal struts; and FIG. 6*e* is a modification of the module wherein arcs replace certain of the linear edges.

FIG. 7, including FIGS. 7*a* through 7*e*, inclusive, relates to another symmetrical dodecagonal curved surface module according to the present invention in which FIG. 7*a* is a perspective view of the intersecting planes which help define the module; FIG. 7*b* is a perspective view of the module so defined; FIG. 7*c* is a perspective view of a triangulated planar approximation of the module; FIG. 7*d* is a top view of the module triangulated by skeletal struts; and FIG. 7*e* is a modification of the module wherein arcs replace certain of the linear edges.

FIG. 8, including FIGS. 8*a* and 8*b*, is a structure comprised of the modules of FIGS. 3*b* and 5*b* and of the comparable structure comprised of the modules of FIG. 3e and 5e in FIGS. 8a and 8*b*, respectively;

FIG. 9, including FIGS. 9*a* and 9*b*, illustrates structures comprised of the elements of FIGS. 2a, 6b, and 2e, 6e, in FIGS. 9*a* and 9*b*, respectively, FIG. 10, including FIGS. 10*a* and 10*b*, illustrates structures comprised of the modules of FIG. 3*b*, 4*b*, and 3*e* and 4*e*, in FIGS. 10*a* and 10*b*, respectively;

FIG. 11 is a partially exploded view of a complex structure employing units comprised of the modules of FIGS. 2, 3 and 6;

FIG. 12 is a perspective view, partly broken away of a portion of the structure of FIG. 11, containing a plurality of parallel planes suitable as an element of a habitable structure;

Figure 1:
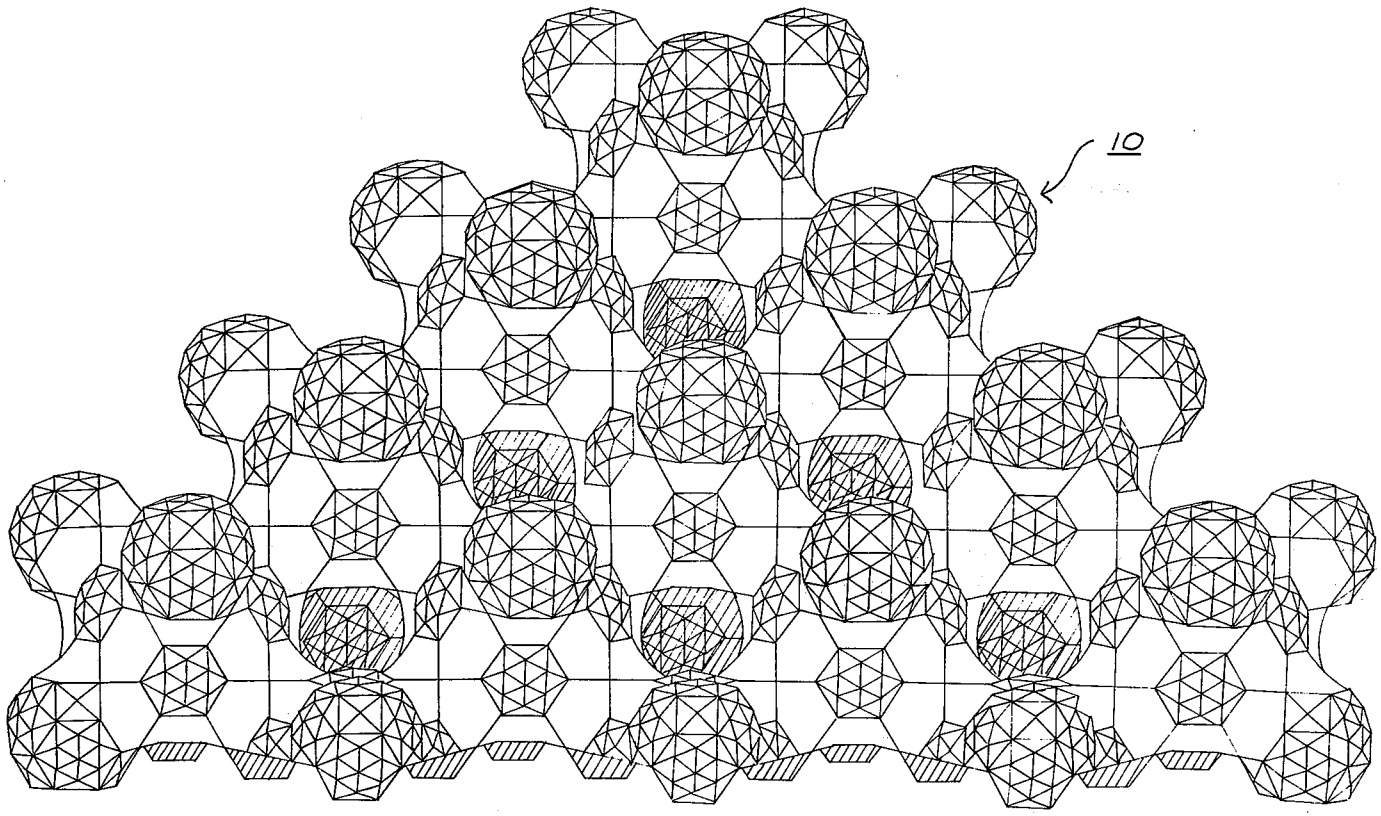
Figure 21:
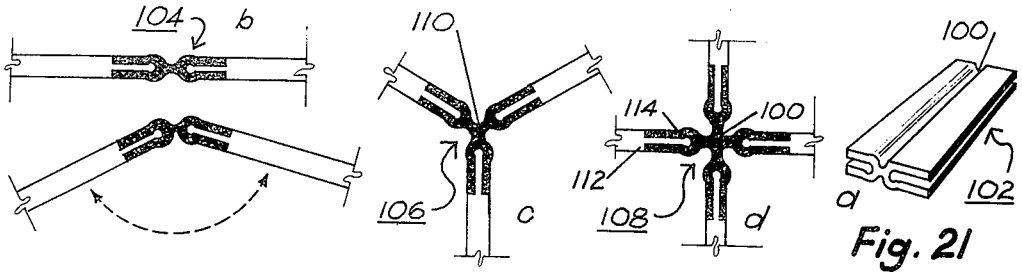
Figure 22:
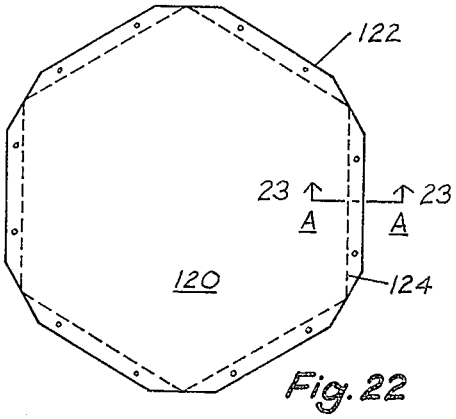
Figure 24A:
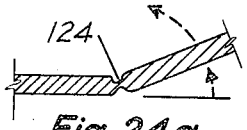
Figure 24B:
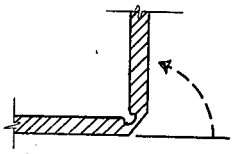
Figure 24C:
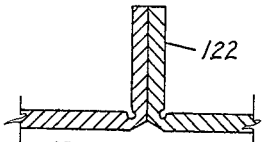
Figure 24D:
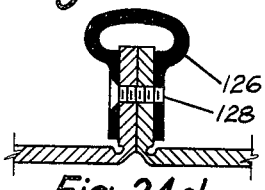
Figure 23:
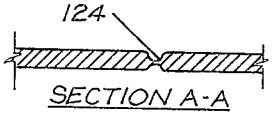
Figure 24E:
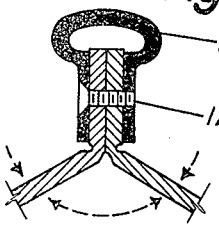
Figure 25:
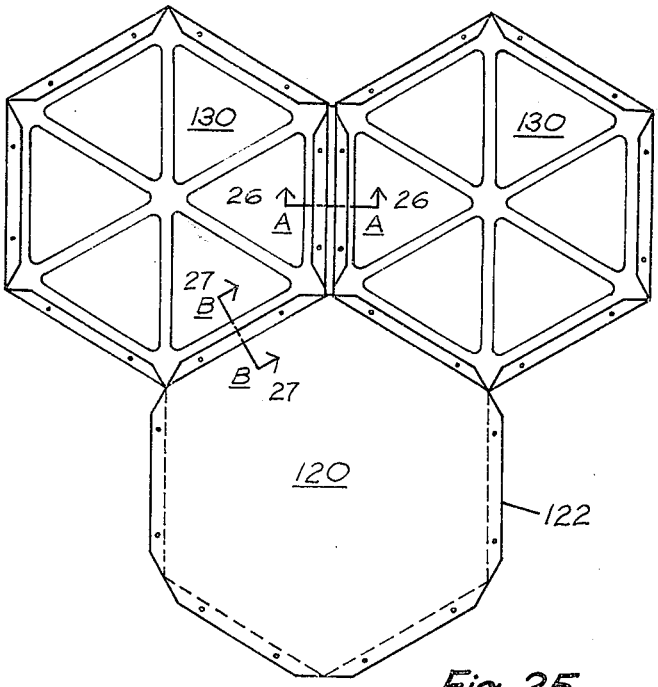
Figure 26:
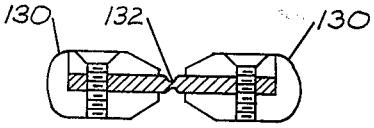
Figure 27:
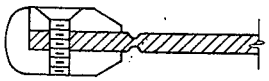
Figure 28:
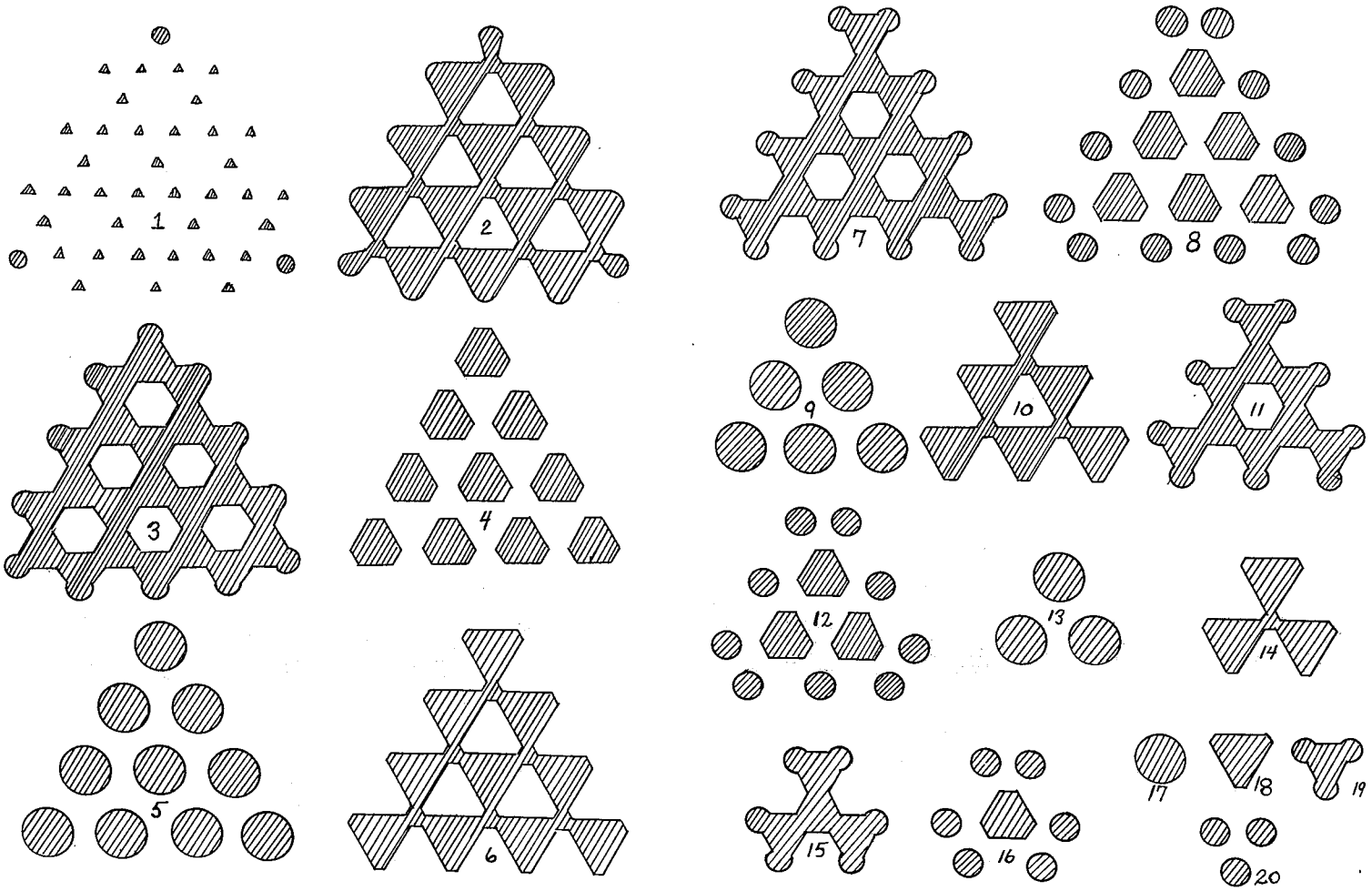

FIG. 19 including FIGS. 19*a* and 19*b*, illustrates two alternative configurations of the same labyrinth system comprising modules with straight edges, FIG. 19*a*, and with curved edges, FIG. 19*b*;

FIG. 20 is yet another complex structure employing modules of the present invention;

FIG. 21 including FIGS. 21*a* through *d*, inclusive, is a perspective end view of coupling hinges suitable for joining the modules of FIGS. 2 through 7;

FIG. 22 is a top view, of a module according to the present invention having a hinged edge adaptable for interconnecting with other similar modules;

FIG. 23 is a sectional view of the module of FIG. 22 taken along line 23—23 in the direction of the appended arrows;

FIG. 24 including FIGS. 24 a through e, inclusive, illustrates the sequential steps of joining modules by clamping edges;

FIG. 25 is a top view of interconnected modules such as are illustrated in FIGS. 3a and 3b;

FIG. 26 is a sectional view of the structure of FIG. 25 taken along the lines 26—26 in the direction of the appended arrows;

FIG. 27 is a sectioned view of the structure of FIG. 25 taken along lines 27—27 in the direction of the appended arrows;

FIG. 28 represents the 20 horizontal planar sections of the structure of FIG. 1.

Turning first to FIG. 1, there is illustrated a multistory structure, comprised for the most part of a superstructure which is in turn assembled from surface modules of the present invention. As illustrated, the structure may be considered a 20 story habitable structure in which floor layers span and, subdivide very large volumetric regions created by the super-structure.

As illustrated in FIG. 1, the structure terminates in domes of the type disclosed in the copending application of the present inventor, entitled "Minimum Inventory Maximum Diversity Building System", filed Aug. 30, 1971, U.S. Ser. No. 176,220. In that application, a building system was disclosed which comprised a plurality of strut members of predetermined dimensions which, when interconnected, provided modular structures using linear frameworks which were triangulated for structural rigidity. Because of the selection of relative sizes of the structural members, dome structures were provided of high volume to weight ratios and of great inherent structural strength and stability.

While it is not essential that such elements of the system of the copending application be employed, they are useful to illustrate the flexibility of the present invention and its ability to accommodate other systems.

In the architectural field, the application of curved space structures to large scale building assemblies is of great interest. Structures can be assembled in larger aggregates from prefabricated modular surfaces produced in reinforced thin shell concrete or even reinforced plastic. Typically, a module for building purposes may measure approximately 13 feet on an edge.

As shown in FIG. 1, a superstructure can be assembled from modules which incorporates both surface and skeletel modules described in greater detail below and skeletal frameworks of the copending Pearce application. Floor layers can then be attached to the superstructure as described herein. Very large volumetric regions are spanned by the floor layers. In proposed embodiments, the largest spans approach 80 feet. A 20 story pyramidal building configuration 10 is shown by way of example.

In this configuration, one of several "tunnel" regions forms the interior of the building. Another is entirely exterior and is represented by the shaded regions. Such a configuration gives rise to a remarkable series of floor plans which are shown below, in detail, in FIG. 28.

In the preferred embodiment of the present invention a set of six, primary, interrelated curved surface modules are defined. These are shown in FIGS. 2–7 inclusive. Their triangulated approximations are also included. The perimetric nonplanar (skew) polygons of each module may be identified in terms of their included angles and the number of sides. The six primary modules are listed in the following Table 1:

TABLE 1

| Modules | No. of Sides of Perimetric Polygon | No. of Primary Edges | No. of Secondary Edges | Included Angles |
|---|---|---|---|---|
| A (20) | 8 | 4 | 4 | 120° etc, etc. |
| B (24) | 6 | 4 | 2 | 90°, 120°, 120°, 90°, 120°, 120° |
| C (28) | 6 | 4 | 2 | 90°, 135°, 135°, 90°, 120°, 120° |
| D (34) | 12 | 8 | 4 | 90°, 120°, 120°, 90°, 120°, 120°, 90°, 120°, 120°, 90°, 120°, 120° |
| E (40) | 12 | 6 | 6 | 120° |
| F (44) | 12 | 6 | 6 | 135° |

It is the combination of the included angles and the number of sides of a given polygon or set of polygons that determines how multiples can be assembled into a curved space structural array. The edges of each polygon are classified as primary or secondary and are indicated in TABLE 1, and in the figures. Any variation in edge length combinations is permissible so long as the angular relationships and the number of primary edges for a given module remain constant.

Figure 2:
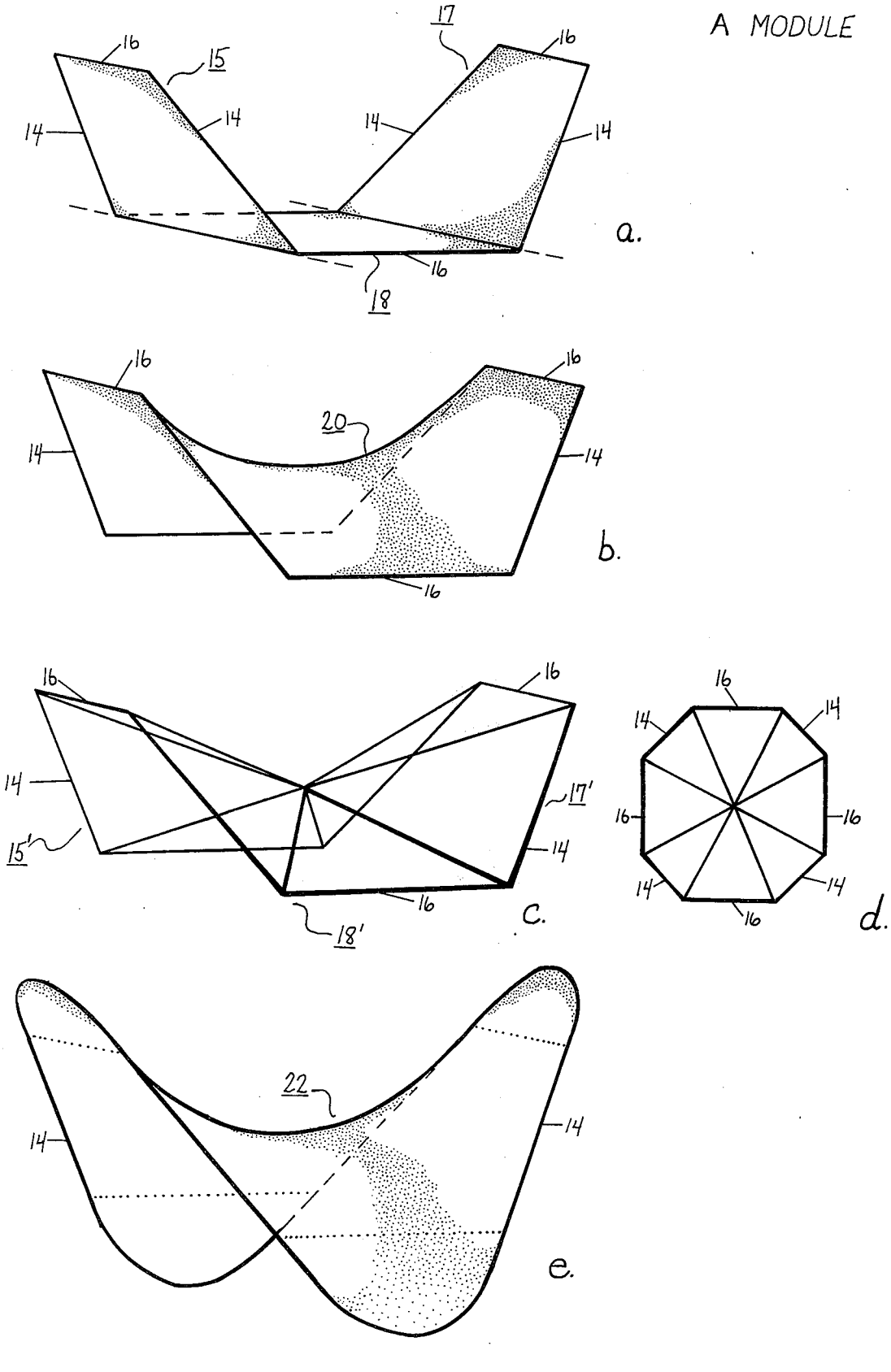

Turning next to FIG. 2, there is shown in FIG. 2*b* an octagonal module 20, which is identified as the A module. This figure, as noted in the table, includes four primary edges 14 and four secondary edges 16. In defining the figure, it may be assumed that two of the primary edges 14 can define a first plane 15, and the remaining two primary edges 14 define a second plane 17, which will intersect the first plane 15 at some point remote of space.

A third plane 18 can be defined by the parallel secondary edges 16 that separate any pair of coplanar primary edges. The third plane 18 which may be considered a base plane intersects the first and second planes 15, 17 at a dihedral angle of 125° 16′. It is to be noted, however, that this mode of describing the figure merely relates to the relative placement of the edges, and in no way constrains the surface, which, according to the present invention, should be a minimal surface bounded by the edges. The included angle between adjacent edges in this module is uniformly 120°.

In FIG. 2*c*, a module 22 having the same perimeter is shown as a triangulated frame without a surface. The frame would include two secondary edges 16 in a base plane 18′ and two primary edges 14 and the included secondary edge 16 forming first planes 15′ intersecting the base plane 18′ at a dihedral angle of 125° 16′. The remaining primary edges 14 and the included secondary edge 16 also form a plane 17′ intersecting the base plane 18′ at a dihedral angle of 125° 16′. For structural rigidity, a strut would be placed at each apex, with the several struts intersecting at the centroid of the figure.

An alternative embodiment of the module 20 is illustrated in FIG. 2*e*, in which the primary edges 14 of the A module 20 have been extended and are joined by an arced apex, rather than a secondary edge 16. The resulting module 22 then becomes primarily a quadrilateral polygon. All other relationships are maintained, and the modified A module 22 could be utilized virtually interchangeably with the A module 20 of FIG. 2*b*.

Figure 3:
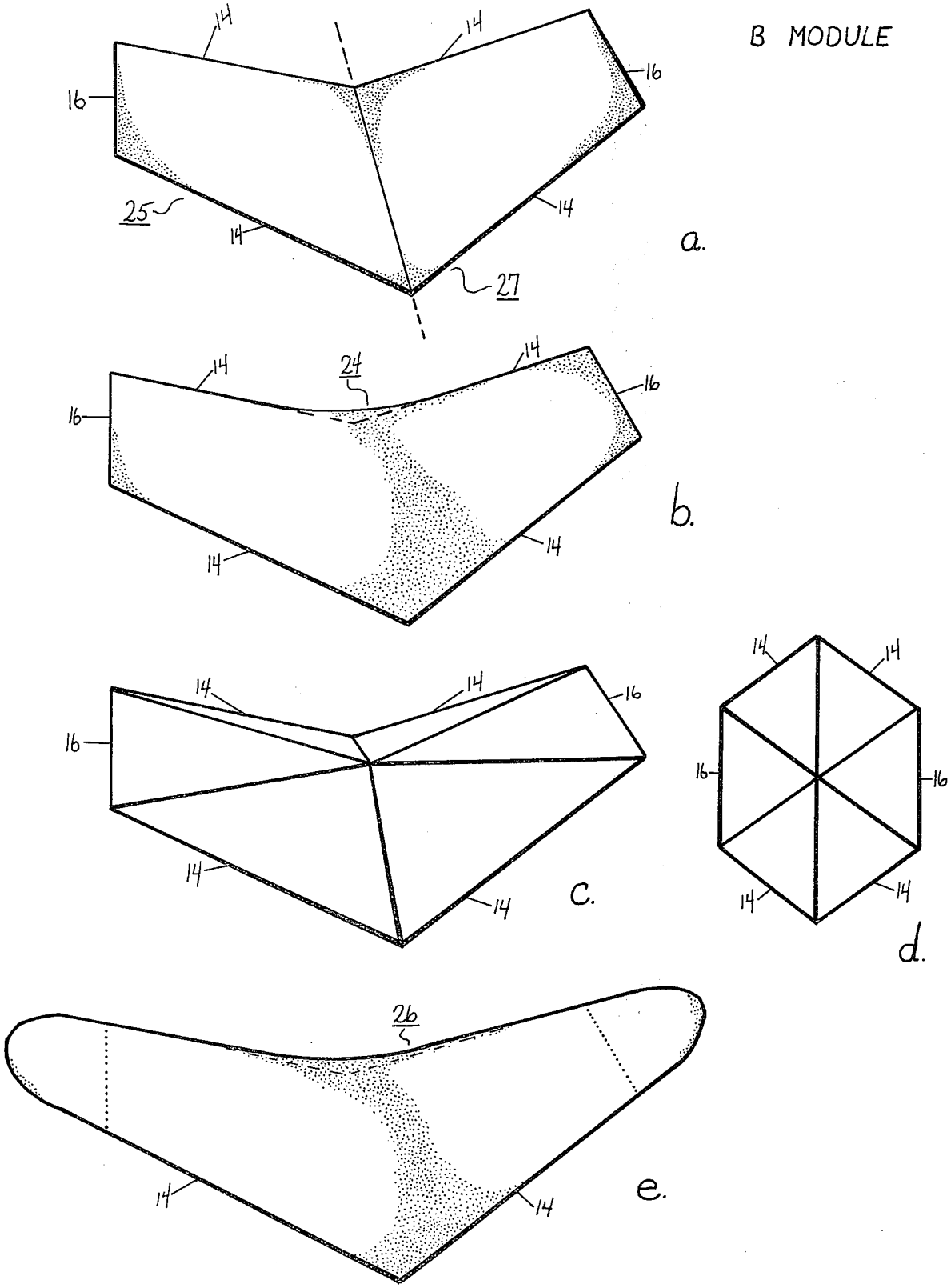

A second or B module 24 is illustrated in FIG. 3 as a hexagonal module having four primary edges 14 and two secondary edges 16. In this B module 24, the primary edges 14 meet. A first plane 25 is defined by two primary edges 14 and an included secondary edge 16. The remaining primary edge 14 and the included secondary edge 16 defines a second plane 27 which intersects the first plane 25 at a dihedral angle of 109° 28′. As noted in Table I, the primary edges 14 meet at an angle of 90°, but primary 14 and secondary 16 edges meet at 120° angle.

In FIG. 3*c*, the alternative triangulated form of the figure is illustrated, which includes triangulation for rigidity in the absence of the minimal surface. In FIG. 3*e*, the B module 24 is modified by extending coplanar primary edges 14 to form arced apices, resulting in a substantially quadrilateral figure 26, as well.

Figure 4:
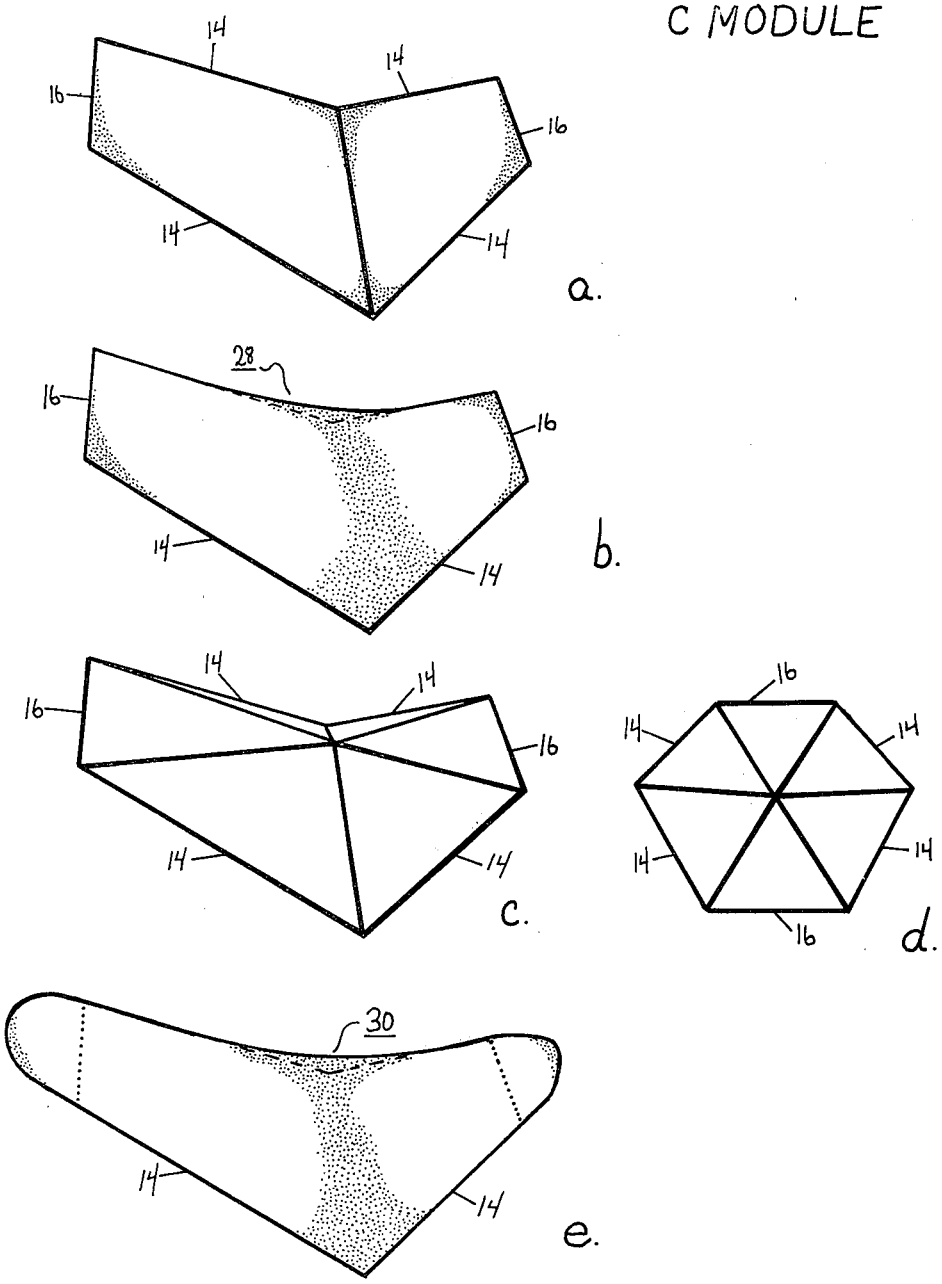
Figure 4:
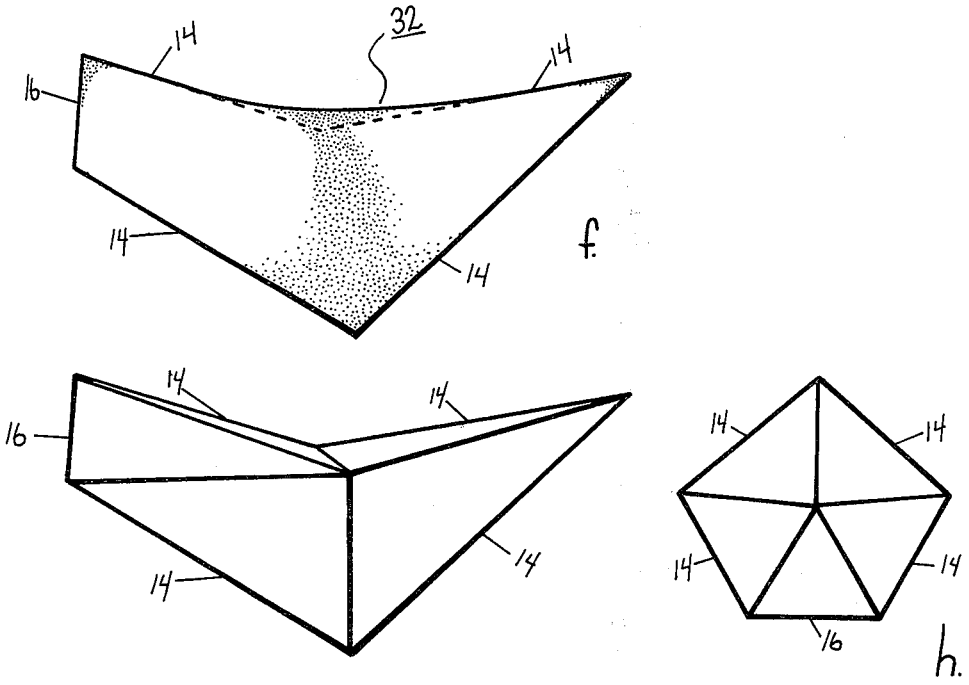
Figure 5:
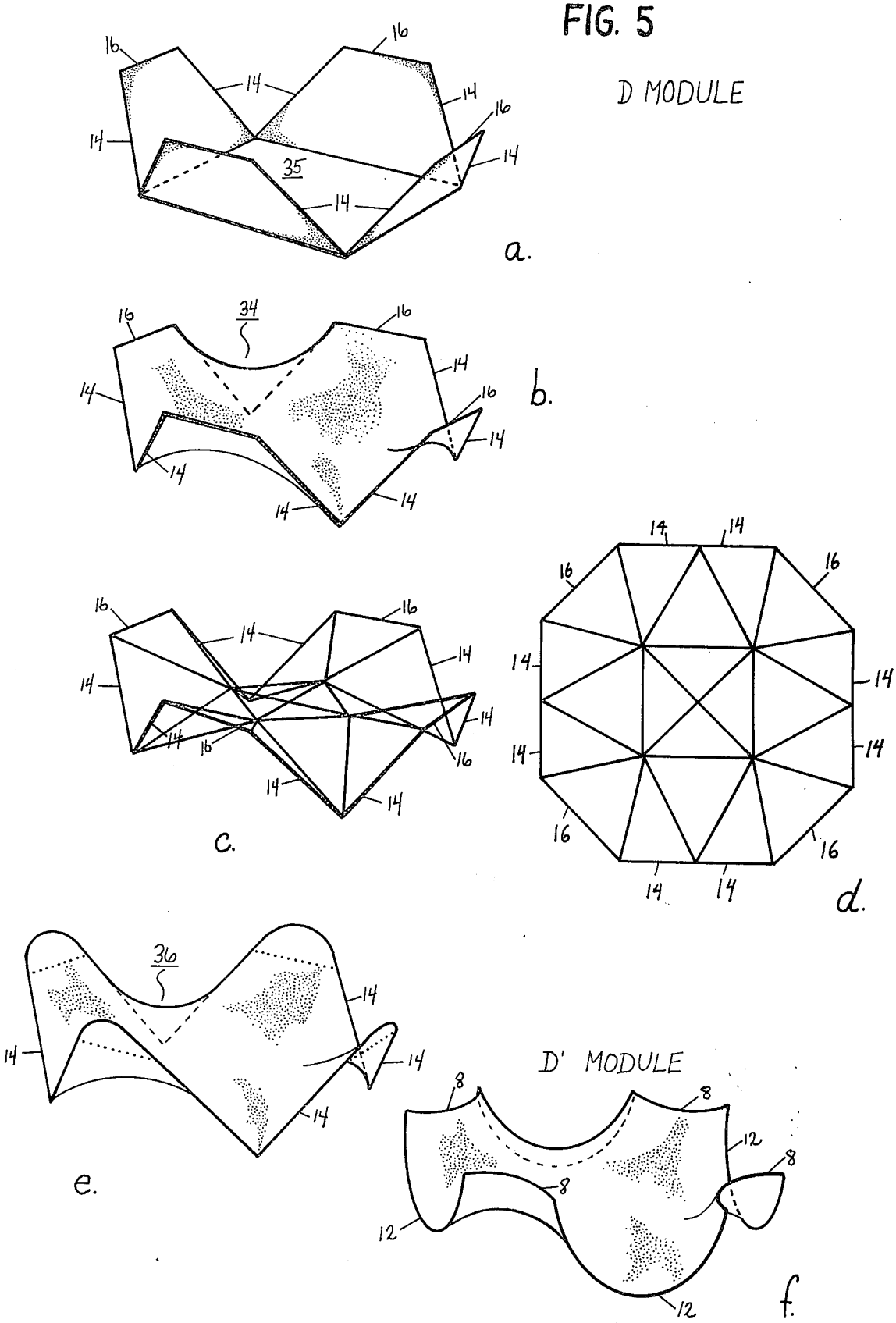

In FIG. 4, there is shown a C module 28, which is also a hexagon. In the C module 28, as in the B module 24, the primary edges 14 meet at 90° angles. The planes formed by the primary edges and the included secondary edges 16 intersect at a dihedral angle of 125° 16 minutes, as with the A module 20 of FIG. 2 above. In the C module 28, one of the secondary edges 16 meets the primary edges 14 at angles of 120° while the other of the secondary edges 16 meets the primary edges at angles of 135°. This makes for a less uniform figure in that the secondary edges 16 are not the same length.

In FIG. 4*c*, the triangulated version of the C module 28 is illustrated, and in FIG. 4*e*, a virtual quadrilateral polygon 30 is formed by extending the primary edges 14 and substituting arced apices for the secondary edges.

A modified version of the C module is illustrated in FIG. 4*f* and has been identified as the C′ module 32. This alternative module is created by extending two of the primary edges 14 to intersect in place of the secondary edge 16, which intersected at the angles of 135°. The resulting pentagonal module 32 has all of the primary edges 14 intersecting at 90° angles with the secondary edge meeting the adjacent primary edges at an angle of 120°. In FIG. 4*g*, the resulting pentagon is shown in the triangulated frame version.

In FIG. 5*b* there is illustrated a dodecagonal module identified as a D module 34. The primary edges 14 of this module 34 meet at a 90° angles, while the secondary edges 16 join the primary edges at 120° angles. Given a base plane 35 defined by the four 90° apices of the primary edge 14 intersections, each of four planes that intersect the base plane can be defined by each secondary edge 16 and the two primary edges 14 connected to it. Each of these planes intersect the base plane 35 at the dihedral angle of 125° 16′.

In FIG. 5*c*, the triangulated frame version of the module 34 is illustrated, and in FIG. 5*e*, a modified figure 36 is illustrated in which the primary edges 14 are extended to meet at arced apices, eliminating the secondary 16 edges. This modification results in a substantially octagonal figure.

In an alternative version of the D module identified as the D′ module 38 in FIG. 5*f*, each of the 90° intersections of the primary edges 14 is replaced with a single, curved primary edge 12, and each of the secondary edges are replaced by curved edges 8. The special utility of such a module will appear in conjunction with assembleges to be described below.

Figure 6:
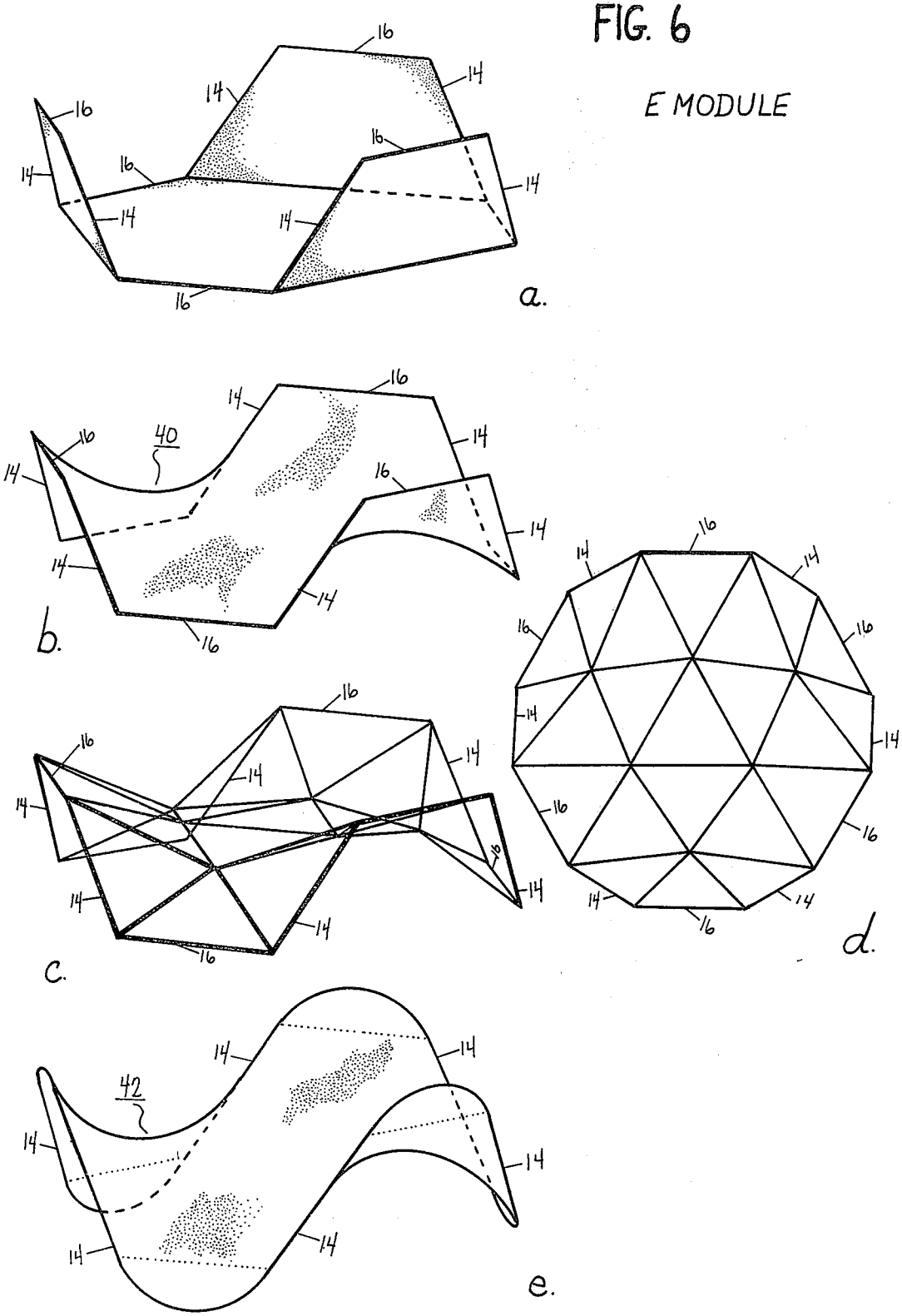
Figure 7:
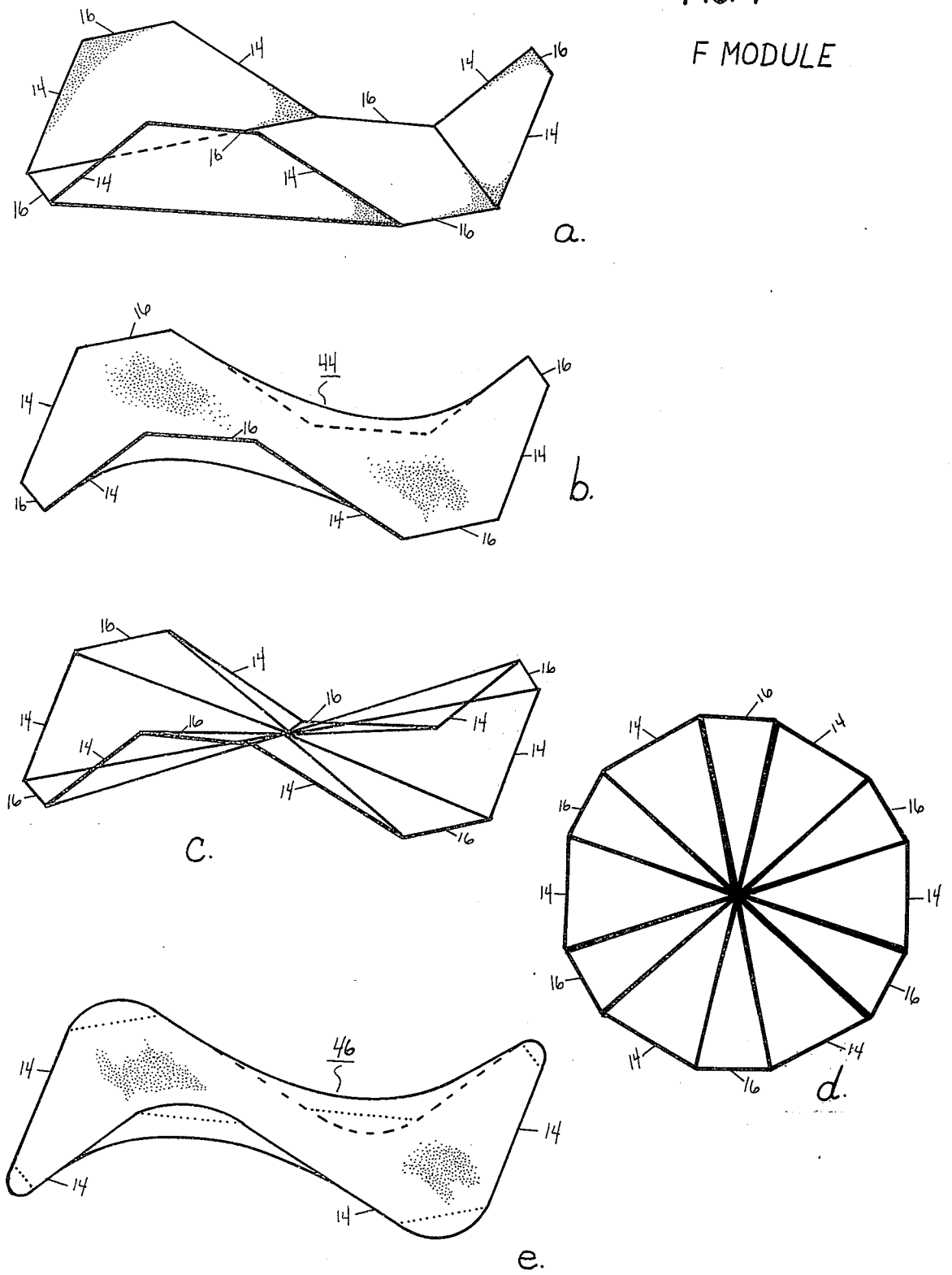

An alternative, symmetrical dodecagonal figure is illustrated in FIG. 6, and is identified as an E module 40. The E module 40 is a symmetrical dodecagon having six primary 14 and six secondary edges 16 with a 120° angle at each edge intersection. Further, a dihedral angle of 109° 28′ is formed by the intersections of the planes defined by the primary edges and included secondary edges and a base plane, said base plane is defined by three coplanar secondary edges. The triangulated version of the E module 40 is illustrated in FIG. 6*c*. In FIG. 6*e* and E module is modified by extending the primary edges to meet at arced apices, to result in an approximately hexagonal figure 42.

A sixth basic module, known as the F module 44, is illustrated in FIG. 7*b*. As may be noted in connection with Table I above, all of the edges of the F module 44 intersect at an angles of 135°. The F module 44 has six primary 14 and six secondary 16 edges, and the dihedral angles formed by the intersection of the plane defined by each set of two primary edges and the included secondary edge with a base plane defined by the remaining three secondary edges is 125° 16′. In FIG. 7*c*, the triangulated frame version of the F module 44 is shown, and in FIG. 7*e*, an approximate hexagonal figure 46 is produced by the extension of the primary edges to meet at arced apices. Any variation in edge length combinations is permissible so long as the angular relationships and the number of primary edges for a given module remain constant.

Particular primary edge combinations govern the formationn of alternative spatial configurations. Secondary edge 16 joining is normally inadvertent. All basic assemblies can be created by joining only primary edges 14 on primary edges 14. Such a procedure automatically provides that secondary edges 16 meet each other.

Also utilized but not illustrated are planar geometric figures such as a hexagon, square and triangle. As discussed in the copending Pearce application, the hexagon and square can also be represented in triangulated form. These flat polygonal modules constitute secondary components since they do not determine the basic assembly possibilities. Their occurrence is primarily inadvertent, as these flat polygons are always defined by openings which have been formed by secondary edges 16. In such cases the flat polygons are required for full spatial closure. There are some instances where certain edges of flat polygons may join primary edges 14. However, these are special cases usually related to the termination of structures.

The alternative modules in which the basic elements have been modified by extending the primary edges to meet at arced apices have the same basic assembly capabilities as the primary modules from which they are derived since the primary edges are preserved and the secondary edges virtually eliminated. Triangulated approximations of these modified modular elements are not shown although, in principle, they are possible to form.

Note that a C′ module 32 is shown. This alteration, which eliminates one secondary edge leaves a 5-sided polygon of 4 primary edges and one secondary edge with included angles of 120°, 90°, 90°, 120°. Similar alterations can be made to any of the polygons. This C′ module 32 is shown because it is a particularly useful part as will be developed below.

Note that there is also shown a D′ module 38. In this modification, pairs of primary edges have been merged into continuous arcs and the secondary edges have also been arced. Although the application of this module is more limited than the modified D module 36, it is nonetheless capable of being assembled into structures with remarkable properties as will be shown.

With the basic kit of parts described and shown in FIGS. 2–7, a variety of different spatial assemblies can be made. Some systems can be assembled with only one kind of module. Others require combinations of two or more. It is important to point out that for every spatial configuration that can be assembled from these curved surface modules, an equivalent spatial configuration can be assembled from the corresponding triangulated approximations of these same modules.

A collection of finite saddle polyhedra can be assembled by various admixtures of components from the inventory, including the planar triangles, squares and hexagons. This collection of finite, closed curved spatial cells constitutes a unique set of space filling polyhedra which in various combinations can be packed to fill all space.

From various of these space filling combinations, can be derived a second class of modular curved space structures by symmetrically omitting certain of the partitions shared by adjacent polyhedra in a space filling array. What is generated is a family of different but related, infinite, continuous, curved space, three-dimensional tunnel labyrinths which divide space into two and only two, complementary tunnel regions.

The tunnel regions are separated from one another by the continuous three-dimensional membrane formed by the assembly of certain of the surface modules of FIGS. 2–7. One of the principle properties of such continuous surfaces is that they are approximately smooth throughout. Even at the intersection of one modular surface element to another, there exists no abrupt change in direction of the surface. This is particularly true at the intersections of primary edges, the tangent surface of which tends in all cases to meet at 180° plane angles to one another. There are a few of these spatial labyrinths in which secondary edges meet, such that a discontinuity occurs because surfaces do not meet at 180°, but in these structures too, the overall continuity is preserved through the intersections of primary edges 14.

Figure 8A:
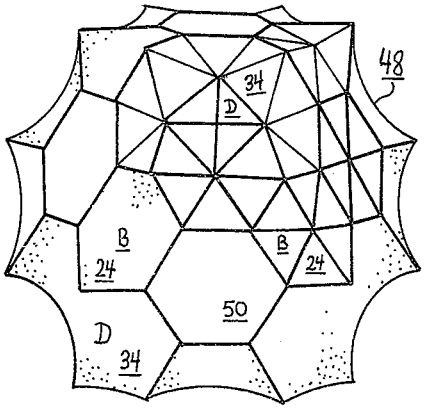

In some examples of these curved space labyrinths, the complementary tunnel regions are identical (congruent) and in others, they are, of necessity, still complementary but non-congurent. These systems are described in more detail below. Different finite curved space cells or saddle polyhedra are illustrated by way of example. In FIG. 8*a* there is shown a figure 48 assembled from twelve B components 24, six D components 34 and eight planar hexagonal components 50. Note that the triangulation of some of these component modules is indicated.

Figure 8B:
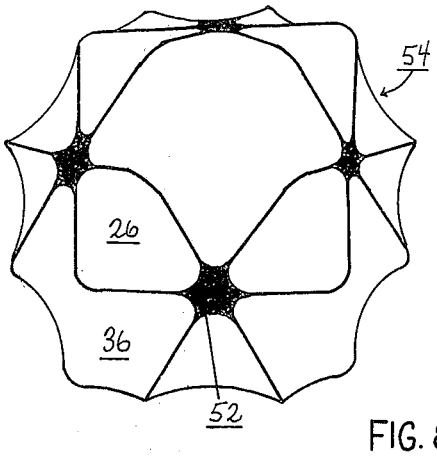

The B and D modules 24, 34 can be replaced with their respective alternative modified forms 26, 36 with the extended primary edges and arced apices. This is best seen in FIG. 8*b*. Note that the planar hexagonal modules 50 are omitted and minimal concave hexagons 52 occur. This example of a modified structure 54 like others below shows the secondary role of the flat hexagons 50 which join D and B components 34, 24 on their secondary edges 16. This saddle polyhedron 54 can fill space in combination with other figures described below.

Figure 9A:
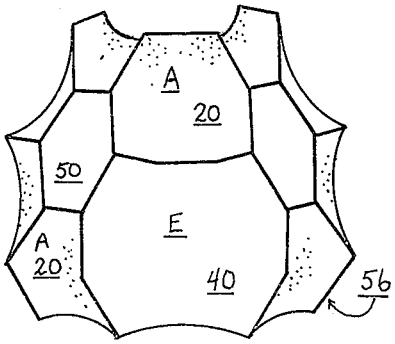
Figure 9B:
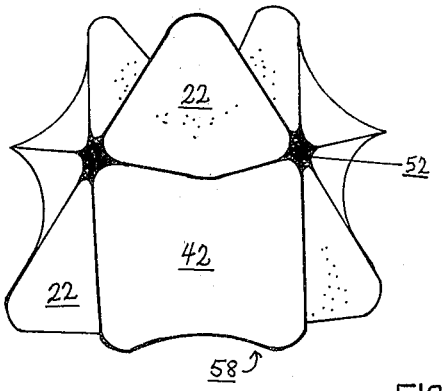

In FIG. 9*a* there is shown an assembly 56 of six A components 20 four E components 40, and four planar hexagons 50. FIG. 9*b* illustrates the equivalent saddle polyhedra 58 assembled from modified A and E components 22, 42 with the primary edges 14 extended and the arced apices. Note again that the flat hexagonal components 50 are replaced by concave hexagons 52.

Figure 10A:
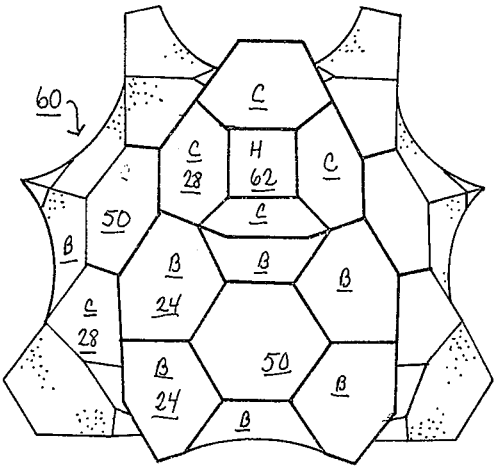

In FIG. 10*a* there can be seen a saddle polyhedron 60 which is equivalent in overall form to the assembly 56 of FIG. 9*a*. However, it is assembled from a different set of components: namely, 24 B components 24, 24 C components, 28, four planar hexagonal components 50 and six square planar components 62.

Figure 10B:
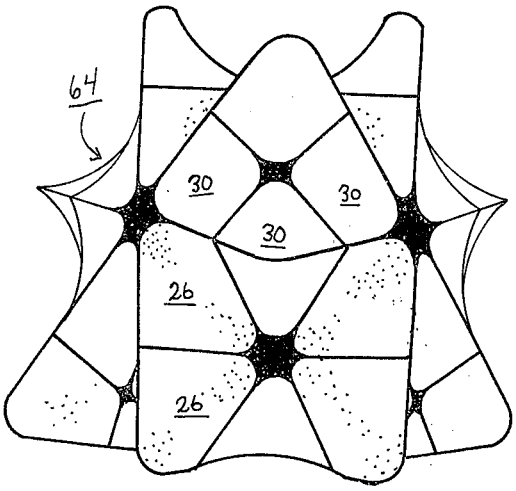

The equivalent configurations can again be assembled from the appropriate set of alternate modules 26, 30 with extended primary edges and arced apices as in FIG. 10*b*. Note that both the flat hexagons 50 and squares 62 are diminished, again revealing the secondary role of these flat polygonal modules. The assemblies 56, 58 and 60,64 of both FIGS. 9 and 10 form saddle polyhedra that will fill space by themselves as well as in combination with other spatial units.

Turning to FIG. 11, a space filling is provided in which some of the E modules 40 are removed to result in a continuous curved space labyrinth which divides space into two congruent regions. These two regions comprise two mutually exclusive, yet complementary tunnel regions. Each tunnel region conforms to the mapping of a uniform periodic network in which 4 edges meet at each vertex in the array at approximately 109° 28′. In effect, a "4-way" tunnel labyrinth is formed.

As was noted earlier, one of the properties of such continuous surfaces is that the modules meet one another at approximately 180° thereby forming a surface continuity from one modular unit to another. Such structures can be indefinitely extended. In this case they are extended by the repetition of A 20 and planar hexagonal 50 components only.

However, such structures cannot actually grow indefinitely and, therefore, require some form of termination. Moreover, without such termination, structural instability results. By way of example, one of the saddle polyhedra 56 has each of its four E components 40 replaced by a set of three B components 24. This illustrates that the continuous labyrinth can be conveniently terminated with either B components 24 or E components 40. Note that when the B components 24 are used for termination purposes, planar triangles 66 result. Some of the A and B modules 20,24 have been shown in their triangulated form. A modified saddle polyhedron 68 is shown with one of its B modules 40 triangulated in addition to singles A and planar hexagonal modules 50. One can see from this that the entire curved space labyrinth FIG. 11 could be assembled exclusively with triangulated modules, exclusively with curved surface modules, or, for that matter, any admixture of triangulated or curved surface modules as may be desirable.

In FIG. 12 there is shown a partial assembly of the curved space structure 68 from FIG. 11 in which a set of parallel planes 70 are included. The planes 70 are defined by certain primary and secondary edges of the constituent polygonal modules from which the curved space structure is assembled. The parallel planes 70 are attached at the edges which define them.

In the preferred embodiment of this system, the edges of all the modules are equal in length in which case, the parallel layers 70 may each be composed of planar arrays of equilateral triangoles 72 whose edges are equal in length to the edges of the curved surface modules. These geometric relationships facilitate the assembly of modular floor trusses which can be hung perimetrically to the building superstructure formed from the curved space labyrinth.

Figure 13:
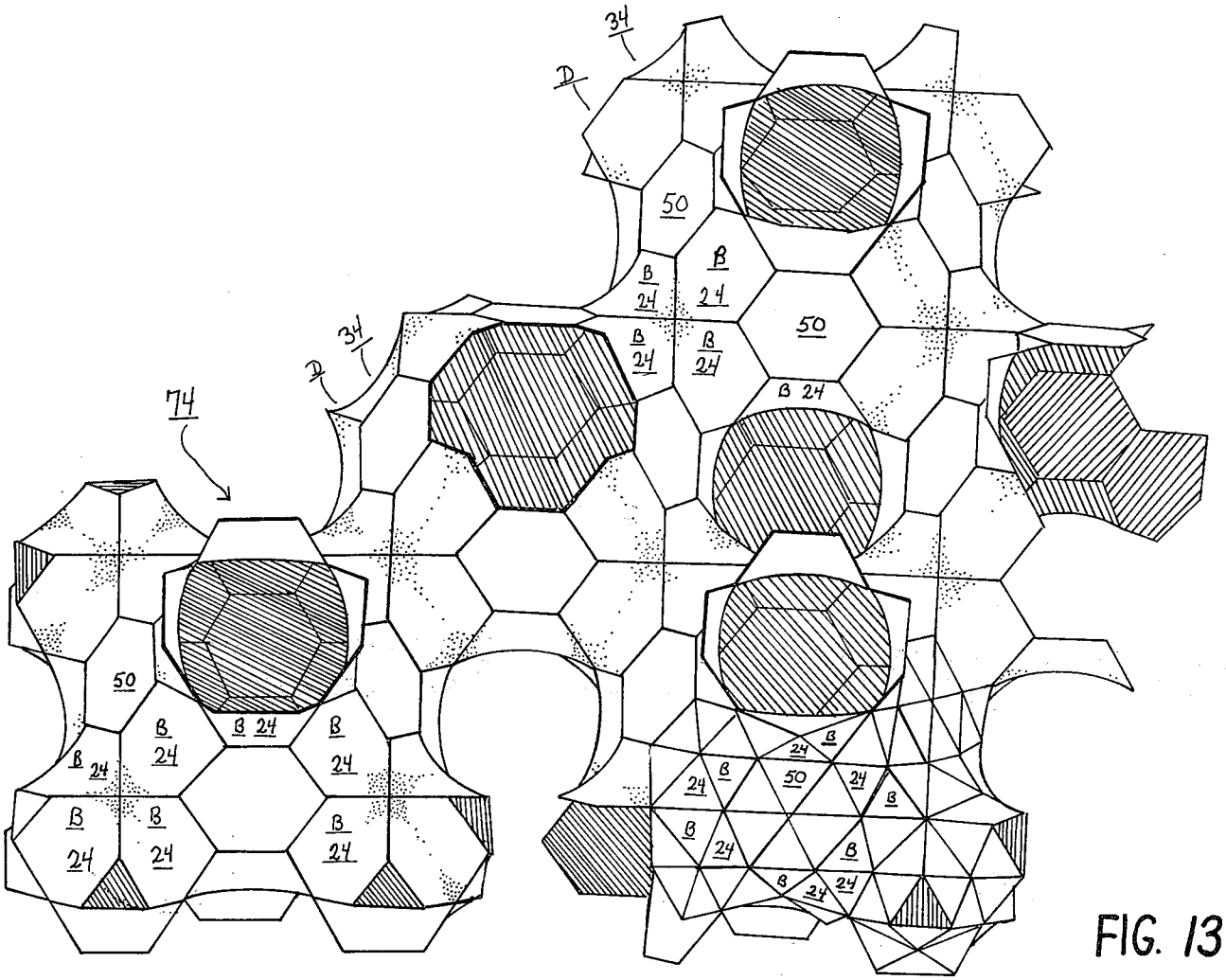
FIG. 13 is a perspective view of a more complex structure utilizing components of the present invention.

In FIG. 13, there is shown yet another curved space structural labyrinth 74 similar to that of FIG. 12. This particular structure can be derived from a space filling system comprised of the saddle polyhedra 48 of FIG. 8*a* and a second saddle polyhedra (not illustrated) in which all D modules 34 are omitted. This results in a labyrinth composed of two congruent tunnel regions. Each tunnel system conforms to a mapping of a uniform periodic network in which 6 edges meet at each vertex in the array at approximately 90°, forming a simple cubic network.

In effect, a 6-way tunnel labyrinth is formed. The entire curved space structure 74 may be indefinitely extended by the repetition of B modules 24 and planar hexagonal modules 50. Like the 4-way labyrinth of FIG. 11, this 6-way labyrinth must also be terminated or closed off if it is to be stable. This is conveniently accomplished by use of additional B modules 24 which again gives rise to the inadvertent occurrence of triangular regions which can be filled by triangular elements 66.

As was earlier pointed out, the inherent stability of a triangle makes the triangle module 66 of optional module since it is not a structural requirement. Note that D modules 34 may also be used for termination purposes.

In FIG. 13 many modules are shown in triangulated form. Like all of the composed described herein, assemblies can be created which are entirely composed of triangulated modules or entirely composed of curved surface modules or any combination of the two types.

Figure 14:
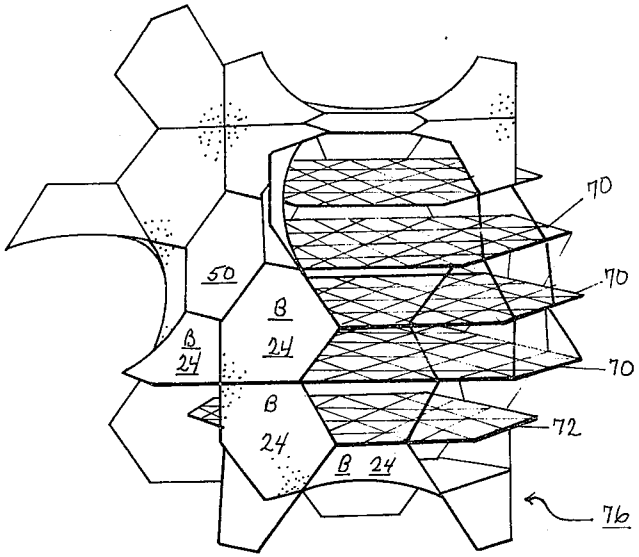
FIG. 14 is a perspective view, partially broken away, of a portion of the structure of FIG. 13 showing a set of parallel planes in the interior of the structure.

In FIG. 14, a partial assembly 76 of the curved space structure 74 of FIG. 13 is shown including a set of parallel planes 70. As in the case of FIG. 12, the planes 70 are defined by certain primary and secondary edges of the component modules and the planes 70 are attached to these same edges.

Also when the edges of all of the surface modules are equal in length the parallel planes 70 may be decomposed into arrays of equilateral triangles 72 with their edges equal in length to the edges of the surface modules. This permits the assembly of modular floor trusses which make possible useful multistory building arrangements with the spatial volumes created by the curved space modular structure.

Figure 15:
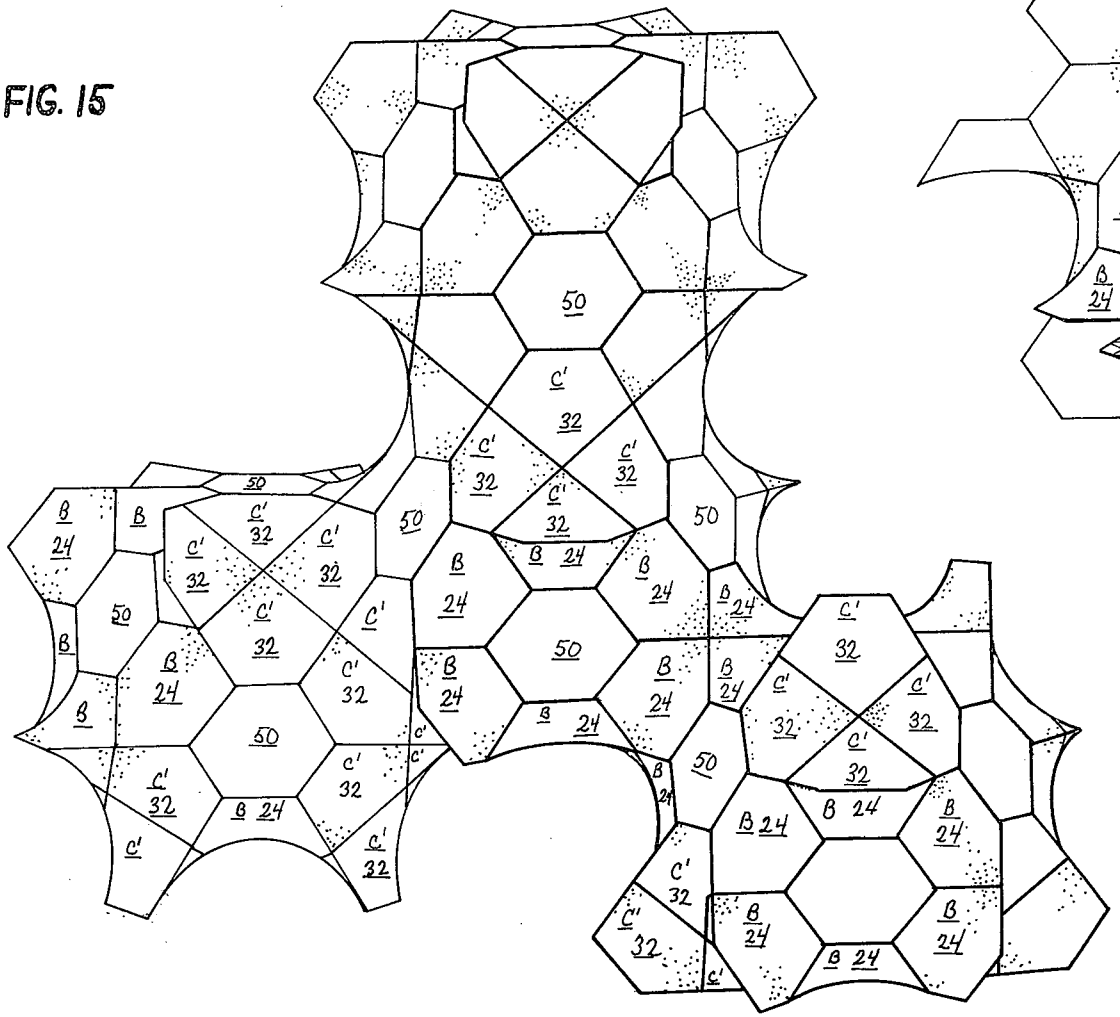
FIG. 15 is an alternative structural combination comprised of the modules FIGS. 3b, 4f of the present invention.

In FIG. 15 can be seen a partial space filling array which includes four saddle polyhedra 78 similar to the type seen in FIG. 10*a*. The unit polyhedron in this array differs from that of FIG. 10*a* in that the C′ modules 32 have been everywhere substituted for C modules 28, and hence all the planar square modules are omitted. This is a very interesting space filling system since curved space labyrinth structures may be derived that are equivalent to both the 4-way tunnel system of FIG. 11 and the 6-way tunnel system of FIG. 13. If, in a space filling array of this saddle polyhedron 78, all B components 24 and the planar hexagons 50 which are surrounded by B components 24 are omitted, the 4-way tunnel labyrinth is formed. It would be composed of C′ components 32, and planar hexagons. If, on the other hand, all C′ components 32 are omitted, the 6-way tunnel labyrinth is formed. Like the structure of FIG. 13, it would be composed entirely of B components 24, and planar hexagons 50.

Because these two different tunnel systems can be derived from the same space filling saddle polyhedron, it is possible to build single continuous structures that incorporate sections from both 4-way and 6-way tunnels.

Figure 16:
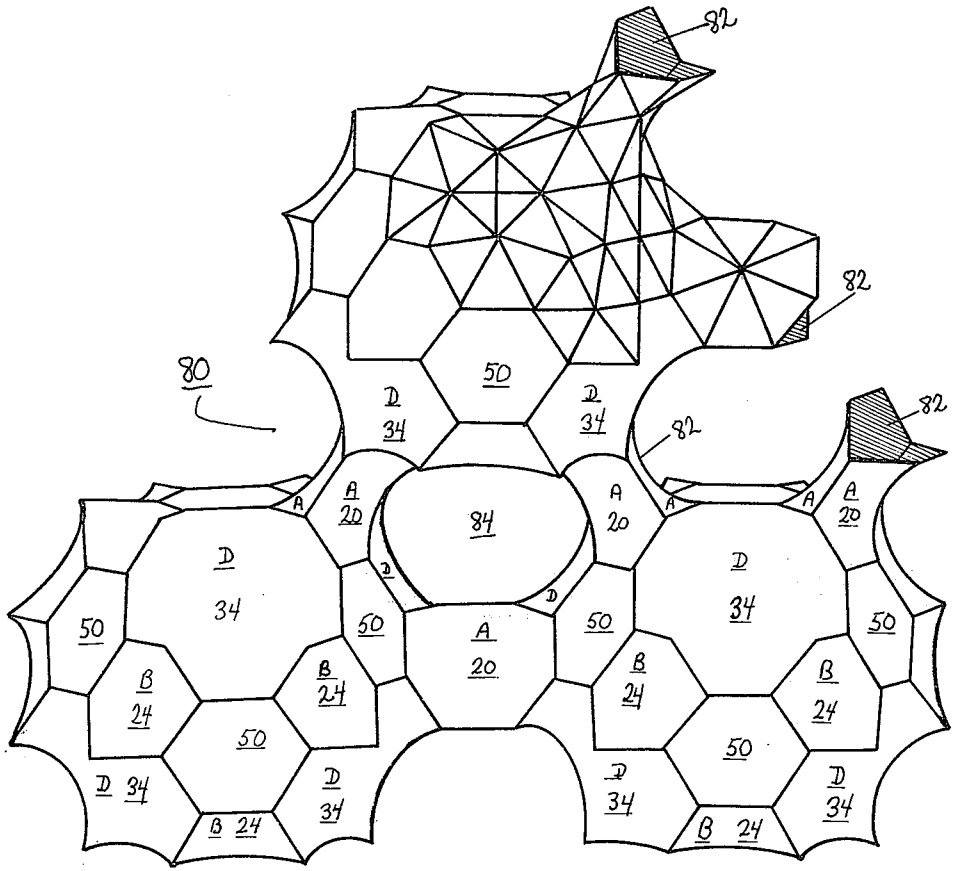
FIG. 16 is a perspective view of a tunnel labyrinth structure comprised of modules of the present invention.

An assembly of a section of another tunnel labyrinth 80 is shown in FIG. 16. Note that although B modules 24, are omitted to create the continuous labyrinth 80. Other B modules 24 are used for termination purposes. Twelve tunnels 82 emanate from each of the FIG. 8*a* saddle polyhedra 48 in a periodic array. Each tunnel consisting of two A modules 20 in turn is joined to another FIG. 8*a* saddle polyhedron 48, etc. Hence the 12-way tunnel system is formed.

A 4-way/9-way tunnel system 84 is the larger left over space. Note that in the labyrinth assembly 80 of FIG. 16, some of the modules are shown as triangulated components. The entire structure could be comprised entirely of surface modules, entirely of triangulated modules or any admixture or combination as desired. It should also be noted that the parallel floor planes 70 mentioned earlier in connection with FIGS. 12 and 14 and their governing parameters, apply equally well to this configuration.

Figure 17:
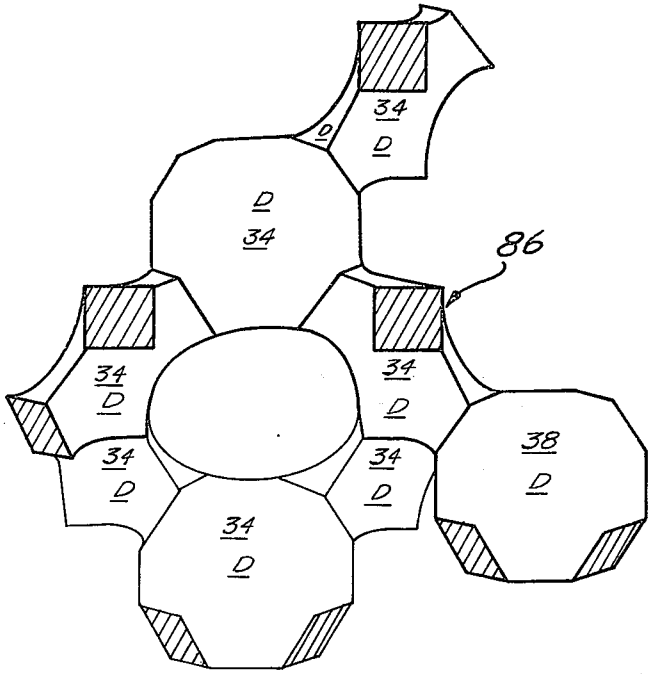
FIG. 17 is a view of a labyrinthine structure comprised of modules of FIG. 5*b* of the present invention.

In FIG. 17 is shown yet another spatial labyrinth which is derived from another space filling system. The spatial labyrinth 86 is assembled entirely from D modules 34 in which two complementary but dissimilar tunnel regions are formed. One such region conforms to a uniform network in which 8 edges meet at each vertex at angles of approximately 70°32′. The complementary tunnel system conforms to a uniform network in which 4 coplanar edges meet at each vertex at approximately 90° angles. In effect, an 8-way/4-way tunnel complex 86 is formed.

Figure 18:
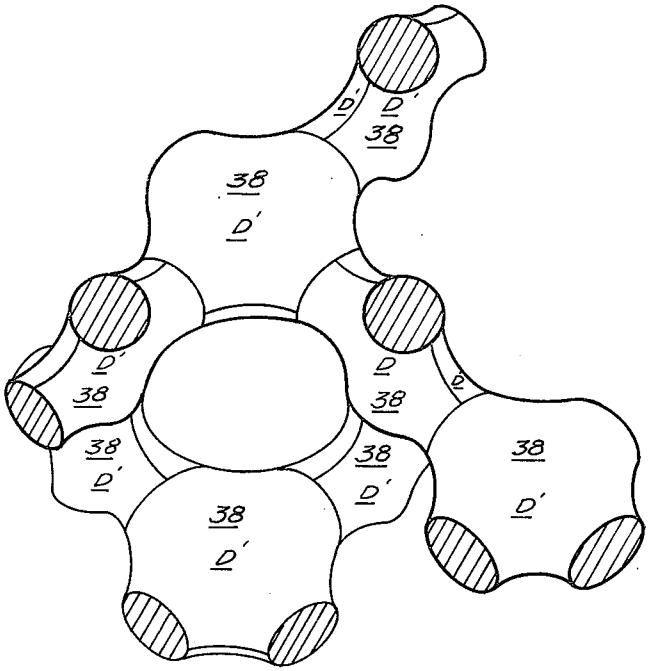
FIG. 18 is a perspective view of a labyrinthine structure substantially identical to that of FIG. 17, except that the modules of FIG. 5*b* utilized in the structure of FIG. 17 have been replaced by the modules of FIG. 5*f*.

In FIG. 18 there is shown the same general configuration as in FIG. 17, except D′ modules 38 have been substituted for D modules 34 everywhere.

In FIG. 19*a* there can be seen an alternative labyrinth system 88 which is not derived from a system of space filling saddle polyhedra, but which is nonetheless, assembled from modules defined in TABLE I. A labyrinth system 88 is assembled from E components 40 in which the two complementary regions are congruent and each conforms to a mapping which defines a semi-uniform net.

At one kind of vertex 3 edges meet in a common plane at approximately 120° and at a second kind of vertex 5 edges meet 3 edges in a common plane at approximately 120° and 2 edges normal to said plane from either side. In effect, a 5/3-way tunnel system is formed.

This particular curved space labyrinth 88 has more frequently occurring surface discontinuities along the edges where modules are joined than in any of the other systems described, but they are not so severe as to destroy the flow of the labyrinth.

These same discontinuities can be reduced and even eliminated by intoducing some curved edges to some of the modules. FIG. 19*b* shows a modified version of FIG. 19*a* in which curved edges are introduced to eliminate such discontinuities.

In FIG. 20 there is shown a partial space filling arrangement composed of yet other saddle polyhedra. These polyhedra are comprised of A and B modules, 20,24 and planar squares 62. As is shown, continuous enclosed spaces can be created.

It can be easily demonstrated that doubly curved surfaces or shells of the types exemplified by the inventory of modular units in FIG. 2–7 have very high strength to weight characteristics when produced in appropriately rigid materials. They have substantially greater strength per unit of invested material, or per unit of material thickness, than do planar surfaces.

The space filling saddle polyhedra disclosed herein have some unique advantages as high efficiency structures due to the periodic interaction of the already efficient, doubly curved surfaces. Such interactions serve a self-stabilizing and stress-distributing function. The modular curved space labyrinths have basically the same properties, but may be considered optimal forms in the sense that they are minimum redundancy structures.

They are characterized by an extraordinarily large containment of volume for the surface area, and although there is no actual formation of an array of finite volumetric units or cells, this is implicit in the tunneling system. Perhaps even more than the space filling polyhedra, these curved space, continuous surfaces open up wholly unprecedented possibilities for structural design.

Although it is implicit in all of the configurations described above, it is with the continuous surface systems that one clearly abandons any references to the conventional spatial orientation and constraints usually associated with structural design and architecture. The spatial labyrinths of continuous surfaces have no inherent "inside" or "outside", "up" or "down," "horizontal" or "vertical", etc. All of these orientations can be assigned to a structure, but they are not inherently dictated by the geometry of the structure itself.

As was pointed out above, these labyrinths divide space into two regions; that is, they create two-side surfaces. "Inside" can be either of its two sides. This will usually depend on the means by which these "infinite" systems are terminated or closed off into finite structures. "Up" and "Down" and "Horizontal" and "Vertical" may be determined with reference to specific environmental contexts or use, but not by the structure itself.

In order to differentiate an "inside" from an "outside", it is necessary, as a minimum condition, to subdivide space into at least two regions. Any simple finite cell such as a single sphere or cube does this very well. If one wished to subdivide space indefinitely or even in a nominally repeatable way, into at least two regions, then the continuous surfaces have extremely useful properties.

As a family of structures, the spatial labyrinths will subdivide space into two regions with less surface area than any other kind of space enclosing system. This, in connection with their efficiency as physical structures, promises assemblies of minimum redundancy, i.e., structures which enclose a great amount of repeatable volume while requiring a minimum of invested resources.

The present invention includes curved surface modules and their triangulated approximations. Empirical observations show that there is a surprising similarity of behavior between the linear frameworks described and shown in the copending Pearce application and saddle surfaces when they are both considered in terms of periodic, modular associations. Much of the structural approach presented herein depends upon the assumption that those spatial arrangements of phsyical modules, be they linear branches or surfaces, which form fully stable geometrical arrangements, will be more efficient as structures than those which do not form stable geometric arrangements.

Efficiency is taken here to mean the ratio of resources investment required to resist a given amount of stress (or stresses), to the amount of volume enclosed. Stated another way — it will take less material to resist a given amount of stress while enclosing a given volume with a modular system that is inherently stable, than is required with a system that is not inherently stable.

The basic principle of geometric stability governs the behavior of both branch and surface systems. In the case of finite branch systems, the principle of geometric stability is simple enough. Namely, that only fully triangulated systems are inherently stable.

If a finite system is entirely enclosed by surfaces it will also be stable. If these surfaces are all flat, as in plane faced polyhedra, local instability results when concentrated loads are applied to the faces. If the surfaces are curved, the local instability is diminished or completely eliminated. It will be seen that in a physicogeometric sense, only fully triangulated polyhedra, or fully surfaced polyhedra may be considered closed and, therefore, stable, and that the saddle polyhedra overcome, to a large extent, the local instabilities of the plane faced polyhedra.

A finite saddle polyhedron clearly illustrates the structural enhancement of doubly curved saddle surfaces when they are associated in aggregate. The isolated saddle surface undergoes stress that is completely cancelled out by the interaction of saddle surface in an aggregate. The isolated saddle surface is invariably expected to function as a cantilever which introduces bending stresses that are unknown to periodic arrays of such surfaces. This fact can be appreciated by working with scale models.

Individual surface modules, when formed from thin plastic such as rigid vinyl, are relatively flexible and easily bent. When a set of such modules are assembled to form a closed saddle polyhedron, they become extraordinarily rigid by virtue of the manner in which they must interact with each other. An inherently stable configuration is formed which behaves not unlike a fully triangulated network structure with respect to their tendency to distribute stress.

With infinite periodic structures, the question of stability is far more subtle and interesting than in the case with finite triangulated frameworks. There are two basic classes of infinite periodic structures which have counterparts in both triangulated systems and surface systems. First, there are those systems which are aggregates of stable finite polyhedra; and second, there are those systems which are continuous infinite labyrinths assembled by the repetition of discrete polygonal modules. Such infinite labyrinths are frequently derived from periodic arrays of finite polyhedra but they are not of themselves composed of finite stable cells.

Infinite labyrinths, be they surface or skeletal systems, are only stable when they are infinitely large. When such infinite systems are arbitrarily terminated, they become unstable; however, this does not always affect stability at the center of such structures, depending on the configuration. It is not actually possible to realize an infinite structure, and accordingly all structures must eventually be terminated.

If total stability is to be maintained, it is necessary for such structures to be closed by curved surfaces or triangulated frameworks. In other words, in a very real sense an infinite open structure must ulitmately be transformed into a finite closed structure, as finite structures are the only realizable structures that are stable.

The class of periodic structures which are composed of finite stable cells do not, of course, have such a terminal problem. They can be stopped at any arbitrary region and will remain stable. The continuous surfaces as infinite systems are highly stable when properly terminated, and the smoothness of transition of one surface module into another provides an extraordinary distribution of stress whether due to concentrated or distributed loads.

From an experimental point of view, the stability of periodic systems (or any system)) can be determined by assemblies in which the joining of all elements, be they branches or surfaces, is done with hinging connectors. In the case of the branch systems, a multidirectional hinge is desirable, and in the case of saddle surfaces, which join along common edges, a simple two-dimensional hinge is appropriate. A very slight load (usually just the weight of a model) will reveal an unstable condition.

The hingeable joint is an effective way to verify the inherent stability of these systems. In the case of triangulated framework structures, all loads remain axially in the members and no bending loads are induced. The same principle is operative in the case of fully stable, continuous curved space labyrinths. That is, all loads remain in the surface modules and bending is minimized if not altogether eliminated.

The prime areas of application for the curved space structures outline above are in the fields of structure toys, playground structures, and modular prefabricated architectural systems, although they are not limited to those fields.

In the structure toy field two different embodiments of the invention are appropriate. In one case a complementary family of closed, saddle polyhedra cells would be formed each as a single piece of plastic by blow molding or formed in two or three subunits by injection molding and then bonded together permanently to form closed spatial cells.

Such a family of complementary cells would be dimensionally coordinated so they could be combined and stacked like blocks in various spatial arrangements. Such a set of curved space play blocks would provide an instructive and imaginative alternative to the old fashioned cubic building blocks. Such a curved space block set could be designed as a gravity dependent stacking system without special provisions for joining. With special snap or friction fastening techniques, the saddle polyhydra blocks could be held together in a variety of gravity defying arrangements.

In the second toy embodiment of the curved space structures, a kit of parts would be produced which would include a series of polygonal saddle modules from TABLE I, formed or molded in plastic. Various saddle polyhedra, saddle polyhedra packings, and curved space labyrinths can be assembled by linking the individual surface modules with a special longitudinal joining system.

Turning next to FIG. 21, there is shown a joining system consisting of an extruded element 102 approximately equal in length to the edge lengths of the modules. It is produced in a soft, flexible plastic and designed as a hingeable linear unit that will fit over a bead that is formed on the edge of a surface module. As shown in FIGS. 21*b*, and 21*c* and 21*d*, the units can be grouped in bivalent 104, trivalent 106, and quadrivalent 108 form.

The thinned out central regions 100 of these units 102 enables the hinging to occur. A slot 112 runs the length of the joint and includes an interior, expanded area 114 to accommodate the beads on the edges of the modules. The hinging is a requirement if the variety of angles that occur in the curved space structures are to be accommodated. The bivalent joint 104 is used for the assembly of finite, single saddle polyhedra and infinite labyrinth systems since in both these cases only two surface modules meet on a common edge.

The trivalent and quadrivalent systems 106, 108 are used for the assembly of various space filling arrangements which require three and sometimes four surface modules meeting on a common edge. A hingeable joining system not only provides for the complete range of angles at which surface modules meet on common edges, it also enables the user to understand the principles of stability which govern the efficient use of curved space structures.

In the playground structure field, a preferred embodiment of the invention consists of a set of formed plastic modules as shown in FIG. 22 and a corresponding set of skeletal triangulated frames as shown in FIG. 25, with a compatible joint system that permits the interchangeability and admixture of both kinds of modules.

Turning to FIGS. 22 and 23, an ideal form of this system consists of surface modules 120 with edge lengths of approximately 12 inches, injection molded in high density polyethylene or polypropylene material in which integral, hingeable flanges 122 are provided. This is possible due to the properties of these materials which will bend or hinge along all lines formed by locally reduced cross-sections 124. FIG. 22 is a drawing in plan of a planar hexagon module. Such locally reduced cross-sections 124 are shown as broken lines, a cross-section being shown in FIG. 23.

Two surface modules may be attached to each other by folding their hingeable flanges 122 to the proper angles and clamping or bolting them together.

FIG. 24 illustrates a procedure to couple flanges 122 with a series of cross-section views. In order to distribute the pressure of bolts, specially designed longitudinal metal brackets 126 are used which run the full length on each side of the flange connection. Two bolts 128 may be used per flange and, in effect, clamp the brackets 126 onto the flange 122. Because the flanges 122 are hingeable, the variety of angles at which surface modules can meet are provided for as shown in FIGS. 24d and 24e.

Because the curved space labyrinths described above consist of two tunnel regions and, therefore, a two-sided surface, the joining system described above enables assemblies to be made in which one side is perfectly smooth without interruption short of small flush seams where modules meet. On the other side, a series of ribs are formed where the flanges 122 are held together. In a curved space labyrinth like the one shown in FIG. 11, the smooth side of the surface becomes a very effective and unusual environment for children to slide on, while the ribbed side of the surface provides hand holds and foot rests for efficient climbing. The cross-section of the metal brackets 126 which enclose the flanges 122 are contoured so as to provide a comfortable grip for grasping hands.

The ideal skeletal triangulated modules are produced as a one piece aluminum casting. Such a casting is designed so that it can be joined to the injection molded surface module with the same hinging flange system or to itself with a special hingeable polypropylene extrusion. FIG. 25 shows a plan view of two skeletal modules 130 and one surface hexagon module. FIG. 26 shows a cross-section taken along the line 26—26 in which two cast modules 130 are joined to each other by means of a hingeable polyproplene extrusion 132. FIG. 27 shows a cross-section taken along the line 27—27 in which a surface module 120 is attached directly to a skeletal module 130. The hingeable extruded joining member 132 of FIG. 26 has the same ability to accommodate varied angles as the hingeable flanges 122 of the surface module 120.

Such a playground structural system can be used to build all-surface configurations for imaginative play, unusual multidirectional sliding and surface climbing; to build all-skeletal configurations for open frame climbing; or to build any combination thereof.

Referring again to FIG. 1, it will be seen that with a combination of surface modules of the type disclosed in FIGS. 2–7, and with the dome structures taught in the copending Pearce application, supra, a multistory structure can be erected. Turning now to FIG. 28, there is shown in greatly reduced scale, the floor plans of each of the "floors" of the structure illustrated in FIG. 1. It may, for the sake of explanation, be assumed that the structure of FIG. 1 is to be deemed a 20-story structure, with the plan of each floor identified in FIG. 28 by a numeral, commencing with the number "1" representing the ground floor.

In FIG. 28, the shaded areas correspond to a planar floor enclosed within the structure, and the unshaded areas represent openings or an absence of structure. It also may be assumed that, considering the ground floor level, each of the triangular sides has a length of 13'. This would then establish the dimension of the entire structure.

At this scale, the various triangular units of the ground floor might serve as entries for the overlying areas on the second floor. Each of the substantially triangular areas of the second floor would then have a side of approximately 90′ or an area of approximately 5,500 ft².

As may be seen, considering the various stories, the available, enclosed space on each floor is varied and at all levels substantial open space is available for each floor area.

Note the diversity of form that occurs in successive floor layers and note that in many given floor interior areas are islanded from each other. This reflects the tunnel system that is on the exterior. Such a structure provides very low exterior surface to floor area ratios and extraordinarily efficient distribution of stress.

In one possible configuration, the second floor could be devoted to shops and stores, each with separate entries through the enclosed, triangular ground floor structures. The third floor might be utilized for offices and the upper levels could be utilized for apartments. Some levels might be used for schools, theaters, or restaurants where substantial unobstructed interior space is available.

Obviously, a single floor may be devoted to several purposes such as apartments and a school or theater, apartment and offices or offices and restaurants. Further, one or more floors can be combined in a multilevel use to provide, for example, theaters with balconies or multilevel apartments.

For example, the uppermost, twentieth floor can provide three isolated apartments, each approximately 1200 ft.² or the areas may be combined with the nineteenth floor of approximately 4,000 ft.² to subdivide into one or more two-level apartments. Equal division results in three roughly 2,500 ft.² units.

It is clear that the individual modules of FIGS. 2–7 could be combined into a more complex single unit module in that departing from the teachings of the present invention. However, each of the individual modules could be identified in such a combined unit.

It is noted that throughout the application, exact angles measured in degrees and minutes have been set forth. It is to be understood that the concepts of the present invention would not be violated if the angles were modified by 2° or 3° so long as the module substantially met the description set forth here. Accordingly it should be understood that recitations of angles should be viewed as including a margin of error of ± 3°, assuming that dimension relates to the modules when combined into a more complex structure.

What is claimed as new is:

1. A saddle-like polygonal surface module for defining, in conjunction with other, related modules, space enclosing structures, the module comprising:

a nonplanar, skew polygonal periphery, having a substantially minimal surface membrane extending to the periphery thereof to define a saddle-like, structural module, said polygonal periphery having six edges, one pair of opposing edges and an included edge defining a first plane, a second pair of opposing edges and an included edge defining a second plane; the interior angles of the edges defining said first and second planes being 120°, said first and second planes intersecting at a dihedral angle of 125° 16′, the edges at said intersection of planes joining at 90°.

2. A saddle-like polygonal surface module for defining, in conjunction with other, related modules, space enclosing structures, the module comprising:

a nonplanar skew polygonal periphery, having a substantially minimal surface membrane extending to the periphery thereof to define a saddle-like, structural module, said polygonal periphery having eight edges and the interior angles of the vertices each being substantially 120°, one pair of opposing edges defining a base plane, a second pair of opposing edges, together with an included edge, defining a second plane and a third pair of opposing edges, together with an included edge defining a third plane, said second and third planes intersecting said base plane at dihedral angles of substantially 125° 16′.

3. A saddle-like polygonal surface module for defining, in conjunction with other, related modules, space enclosing structures, the module comprising:

a nonplanar, skew polygonal periphery, having a substantially minimal surface membrane extending to the periphery thereof to define a saddle-like, structural module, said polygonal periphery having five straight edges, four of the edges intersecting at 90° angles, and the fifth edge joining adjacent edges at 120°, said fifth edge and the two edges adjacent thereto defining a first plane, the remaining two edges defining a second plane, said first and second planes intersecting at a dihedral angle of substantially 125° 16′, the edges at said intersection of said first and second planes joining at 90° angles.

4. A saddle-like polygonal surface module for defining, in conjunction with other, related modules, space enclosing structures, the module comprising:

a nonplanar, skew polygonal periphery, having a substantially minimal surface membrane extending to the periphery thereof to define a saddle-like, structural module, said polygonal periphery having twelve edges, four pairs of said edges intersecting at four points to define a first, base plane, each adjacent pair of said points also defining the intersection of said first plane with second, third, fourth and fifth planes at dihedral angles of substantially 125° 16′, said second, third, fourth and fifth planes each being defined by a pair of opposing edges and an included edge, each included edge joining adjacent coplanar edges at 120° and the edges intersecting at said points joining at 90°.

5. A saddle-like polygonal surface module for defining, in conjunction with other, related modules, space enclosing structures, the module comprising:

a nonplanar, skew polygonal periphery, having a substantially minimal surface membrane extending to the periphery thereof to define a saddle-like, structural module, said polygonal periphery having twelve straight edges, one pair of opposing edges together with an included edge defining a first plane, a second pair of opposing edges together with an included edge defining a second plane, a third pair of opposing edges together with an included edge defining a third plane, the three remaining, non-intersecting edges defining a base palne, said first, second and third planes, intersecting said base plane, the edges of said pairs being respectively connected to said non-intersecting edges at the intersection of said planes.

6. The module of claim 5, above, wherein the interior angle of the vertices are each substantially 120°, and the dihedral angles of said intersecting planes are substantially 109° 28′.

7. The module of claim 5, above, wherein the interior angles of the vertices are each substantially 135°, and the dihedral angles of said intersecting planes are substantially 125° 16′.

8. A saddle-like polygonal surface module for defining, in conjunction with other, related modules, space enclosing structures, the module comprising:

a nonplanar, skew polygonal periphery, having a substantially minimal surface membrane extending to the periphery thereof to define a saddle-like, structural module, said polygonal periphery having six edges, a first pair of opposing edges being joined by an included third, coplanar edge at angles of 120° to define a first plane and a second pair of edges being joined by an included sixth coplanar edge at angles of 135° to define a second plane, said first and second planes intersecting at a dihedral angle of substantially 125° 16′, said first and second pair of opposing edges being joined at 90° at the intersection of said planes.

* * * * *